US008803048B2

(12) United States Patent
Bassill et al.

(10) Patent No.: US 8,803,048 B2
(45) Date of Patent: Aug. 12, 2014

(54) INDUCTION HEATING AND CONTROL SYSTEM AND METHOD WITH HIGH RELIABILITY AND ADVANCED PERFORMANCE FEATURES

(75) Inventors: Nicholas Bassill, Malibu, CA (US); Clifford Jameson, Christiansburg, VA (US); Dongyu Wang, Blacksburg, VA (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 0 days.

(21) Appl. No.: 13/152,203

(22) Filed: Jun. 2, 2011

(65) Prior Publication Data

US 2011/0290787 A1 Dec. 1, 2011

Related U.S. Application Data

(60) Continuation of application No. 12/128,089, filed on May 28, 2008, now abandoned, which is a division of application No. 10/418,863, filed on Apr. 17, 2003, now abandoned, which is a division of application No. 09/932,752, filed on Aug. 17, 2001, now Pat. No. 6,630,650.

(60) Provisional application No. 60/226,711, filed on Aug. 18, 2000, provisional application No. 60/226,714, filed on Aug. 18, 2000, provisional application No. 60/226,712, filed on Aug. 18, 2000, provisional application No. 60/226,710, filed on Aug. 18, 2000.

(51) Int. Cl.
*H05B 6/08* (2006.01)
*H05B 6/12* (2006.01)

(52) U.S. Cl.
USPC ..... 219/647; 219/626; 219/627

(58) Field of Classification Search
CPC ..... H05B 6/062
USPC ..... 219/647, 668, 626, 618, 665, 660, 661, 219/663, 664, 501, 447, 492; 363/21.16, 363/24, 21.01; 327/252; 323/282; 340/870.05; 375/249
See application file for complete search history.

(56) References Cited

U.S. PATENT DOCUMENTS 3,521,618 A 7/1970 Smith et al.
3,553,647 A * 1/1971 Bullock ..... 340/870.05
(Continued)

FOREIGN PATENT DOCUMENTS

DE 195 17 874 A1 5/1995
DE 196 37 784 C1 9/1996
(Continued)

OTHER PUBLICATIONS

U.S. Appl. No. 12/128,219, filed May 28, 2008, Bassill et al.
(Continued)

*Primary Examiner* — Quang Van
(74) *Attorney, Agent, or Firm* — Foley & Lardner LLP

(57) ABSTRACT

An induction heating and control system and method have enhanced reliability and advanced performance features for use with induction cooking devices, such as induction heating ranges. Enhanced performance is facilitated via the use of an induction heating system which integrates voltage management, power management, thermal management, digital control sensing and regulation systems, and protection systems management.

16 Claims, 13 Drawing Sheets

(56) References Cited

U.S. PATENT DOCUMENTS

| | | | | | |
|---|---|---|---|---|---|
| 3,697,716 | A | | 10/1972 | Kornrumpf | |
| 3,781,506 | A | | 12/1973 | Ketchum et al. | |
| 3,790,735 | A | | 2/1974 | Peters, Jr. | |
| 3,814,888 | A | | 6/1974 | Bowers et al. | |
| 3,821,509 | A | | 6/1974 | Amagami et al. | |
| 4,013,859 | A | | 3/1977 | Peters, Jr. | |
| 4,112,287 | A | | 9/1978 | Oates et al. | |
| 4,191,875 | A | | 3/1980 | Cunningham | |
| 4,303,837 | A | | 12/1981 | Ansaldi et al. | |
| 4,333,110 | A | * | 6/1982 | Faerber et al. | 348/632 |
| 4,358,654 | A | | 11/1982 | Estes | |
| 4,554,671 | A | * | 11/1985 | Collins | 375/249 |
| 4,701,588 | A | * | 10/1987 | Fukasawa | 219/668 |
| 4,713,528 | A | * | 12/1987 | Hirata | 219/492 |
| 5,043,692 | A | * | 8/1991 | Sites et al. | 338/28 |
| 5,215,073 | A | | 6/1993 | Wilson | |
| 5,450,305 | A | | 9/1995 | Boys et al. | |
| 5,581,451 | A | | 12/1996 | Ochiai | |
| 5,772,072 | A | | 6/1998 | Prescott et al. | |
| 5,968,398 | A | | 10/1999 | Schmitt et al. | |
| 6,133,558 | A | | 10/2000 | Ueda et al. | |
| 6,141,466 | A | | 10/2000 | Shigehara | |
| 6,153,863 | A | | 11/2000 | Snowball | |
| 6,175,102 | B1 | | 1/2001 | Stedron et al. | |
| 6,236,025 | B1 | | 5/2001 | Berkcan et al. | |
| 6,325,197 | B1 | * | 12/2001 | Furuya | 194/318 |
| 6,342,817 | B1 | * | 1/2002 | Crofts et al. | 331/1 R |
| 6,455,819 | B1 | | 9/2002 | Pohl et al. | |
| 6,630,650 | B2 | | 10/2003 | Bassill et al. | |
| 6,687,137 | B1 | * | 2/2004 | Yasumura | 363/21.01 |
| 2002/0027175 | A1 | | 3/2002 | Capp | |
| 2002/0117497 | A1 | | 8/2002 | Bassill et al. | |
| 2003/0192881 | A1 | | 10/2003 | Bassill et al. | |
| 2006/0289489 | A1 | | 12/2006 | Wang | |

FOREIGN PATENT DOCUMENTS

| | | | |
|---|---|---|---|
| DE | 198 56 538 | C1 | 12/1998 |
| EP | 0 675 671 | | 10/1995 |
| EP | 0 936 411 | A2 | 8/1999 |
| EP | 1 966 697 | | 7/2002 |
| JP | 03-1114186 | A | 5/1991 |
| JP | 03-132719 | | 6/1991 |
| JP | 05-217665 | A | 8/1993 |
| JP | 07-114983 | A | 5/1995 |
| JP | 09-005398 | | 1/1997 |
| WO | WO 02/17684 | | 2/2002 |
| WO | WO 2007/078891 | | 7/2007 |
| WO | WO 2007/134057 | | 11/2007 |

OTHER PUBLICATIONS

International Search Report dated Dec. 15, 2008 for WO 2007/134057, 4 pages.

International Search Report dated Jul. 25, 2002 for WO 2002/017684, 7 pages.

Office Action for U.S. Appl. No. 10/418,863, dated Apr. 1, 2009, 5 pages.

Office Action for U.S. Appl. No. 12/128,089, dated Dec. 3, 2010, 6 pages.

* cited by examiner

INDUCTION HEATING AND CONTROL SYSTEM AND METHOD WITH HIGH RELIABILITY AND ADVANCED PERFORMANCE FEATURES

CROSS-REFERENCE TO RELATED PATENT APPLICATIONS

This application is a Continuation of U.S. application Ser. No. 12/128,089, filed May 28, 2008, incorporated herein by reference in its entirety, which is a Divisional of U.S. application Ser. No. 10/418,863, filed Apr. 17, 2003, incorporated herein by reference in its entirety, which is a Divisional of U.S. application Ser. No. 09/0932,752, filed Aug. 17, 2001, incorporated herein by reference in its entirety, which claims priority from Provisional Application U.S. Application 60/226,711, filed Aug. 18, 2000, incorporated herein by reference in its entirety and which claims priority from Provisional Application U.S. Application 60/226,714, filed Aug. 18, 2000, incorporated herein by reference in its entirety and which claims priority from Provisional Application U.S. Application 60/226,712, filed Aug. 18, 2000, incorporated herein by reference in its entirety and which claims priority from Provisional Application U.S. Application 60/226,710, filed Aug. 18, 2000, incorporated herein by reference in its entirety and which claims priority from Provisional Application U.S. Application 60/226,713, filed Aug. 18, 2000, incorporated herein by reference in its entirety.

FIELD

The present invention relates generally to induction cooking. The present invention relates more particularly to an induction heating and control system and method having enhanced reliability and having advanced performance features, for induction cooking devices such as induction heating ranges. As discussed in detail below, the present invention comprises an induction heating system which integrates voltage management, power management, thermal management, digital control sensing and regulation systems, and protection systems management.

BACKGROUND

Induction heating for use in cooking is well known. Induction ranges in particular have been designed and built by many different companies. The basic circuitry and coil design for contemporary induction ranges have concentrated on the basic electronics for making induction heating work in a fundamental way. The reliability, the performance and the user friendliness of induction ranges have been limited on contemporary ranges. Contemporary induction ranges have been particularly limited to residential use and have exhibited severe drawbacks which limit their desirability for commercial use. Moreover, the inability to provide high reliability for residential and commercial kitchen induction ranges, the inability to cook at high temperatures and various other performance drawbacks have substantially limited the usefulness of contemporary induction ranges.

For example, most contemporary induction ranges suffer from the deficiency of requiring that each range must specifically be configured so as to accommodate a single input voltage, typically such as either 208 volts or 240 volts. When subjected to a wide voltage range the result is poor voltage regulation of the 50/60 HZ auxiliary housekeeping suppliers used in typical induction ranges.

Further, contemporary induction ranges provide very coarse control of the heating provided thereby. This makes it very difficult to properly cook many food items which require precise control of the heat applied thereto during cooking Further, contemporary induction ranges merely react to the heat control knob and provide a given amount of power in response to the setting thereof. Therefore, different cooking results will occur due to the use of cooking utensils or containers having different magnetic properties. That is, turning the heat control knob of a contemporary induction range to a given setting e.g., the midpoint thereof, will not necessarily result in the same heating effect when different pans (typically having different iron content and thus having different magnetic properties) are utilized. Of course, this results in undesirably different and unpredictable cooking of food items when different utensils or containers are utilized:

Indeed, some cooking utensils or containers are known as "killer pans" because of their ability to over-drive an induction cooker in a manner which results in damage to the induction cooker.

Contemporary induction ranges limit the amount of power which may be applied to item being cooked. This results in undesirably lengthened cooking times. It may even result in the inability to prepare some food items which require a higher level of heat, at least during some portion of the cooking process.

One problem commonly associated with contemporary induction ranges is the leakage of spilled liquid from the cook top to internal electrical circuitry thereof in the event that the cook top become cracked or broken. Typically, such leakage results in substantial damage to the electrical components of the induction range.

Another problem with contemporary induction ranges is that there is no accurate visual indication of the amount of power being utilized in the cooking process. That is, it is not possible to merely look at the induction range and determine the degree to which a food item is being heated.

In view of the foregoing, it is desirable to provide an improved induction heating and control system and method which addresses and mitigates the problems associated with contemporary induction ranges and the like.

SUMMARY

The present invention specifically addresses and alleviates the above-mentioned deficiencies associated with the prior art. More particularly, one aspect of the present invention comprises a method for sensing AC line voltage for an induction cooker, wherein the method comprises sensing a voltage across a secondary winding of a flyback transformer.

According to another aspect, the present invention comprises a method for generating a high resolution, variable frequency waveform, wherein the method comprises providing an oscillator which is configured such that a frequency of an output thereof depends upon a resistance value. A resistor network is digitally switched so as to vary a resistance provided thereby to the oscillator in a manner which varies the frequency of the output of the oscillator.

According to yet another aspect, the present invention comprises a method for cooking with an induction cooker, wherein the method comprises inductively applying power to a ferrous cooking container, sensing the electrical characteristics of the load (ferrous cooking container), the induction coil current of the applied power, and adjusting the power applied based upon the sensed load such that a desired amount of power is applied to the cooking container for maximum performance and protection.

According to yet another aspect, the present invention comprises a method for cooking with an induction cooker, wherein the method comprises sensing a temperature of at least one location proximate the ceramic glass top, and regulating power of the induction cooker so as to maintain a desired value for each sensed temperature for maximum performance and protection.

According to yet another aspect, the present invention comprises a temperature resistant, substantially rigid material for supporting a cooking container during induction cooking, and a temperature resistant, substantially flexible material disposed proximate the rigid material. The flexible material is configured so as to inhibit spilled liquids from undesirably contacting electrical circuitry of the induction cooker in the event that the rigid material cracks, breaks, Or otherwise allows such spilled liquids to pass therethrough.

According to yet another aspect, the present invention comprises a light disposed proximate an induction coil, such as being disposed beneath the ceramic or glass cook top, wherein the light illuminates with varying intensity so as to indicate the power being provided to the cooking utensil or container.

These, as well as other advantages of the present invention, will be more apparent from the following description and drawings. It is understood that changes in the specific structure shown and described may be made within the scope of the claims without departing from the spirit of the invention.

DETAILED DESCRIPTION OF THE PREFERRED EMBODIMENTS

The present invention utilizes advanced technology and systems design to provide the long-term reliability and performance needed by both commercial and residential users of induction ranges. In order for an induction range to operate at desired performance levels and to have long term reliability, a multitude of changing electrical, magnetic, thermal and ambient inputs must be monitored in real time and the system must be able to react promptly to these inputs for the maximum performance, safety and reliability of the induction range.

The induction heating system of the present invention integrates voltage management, power management, thermal management, digital control sensing and regulation systems and protection systems management to provide: low end power control, smooth power control, high temperature cooking, long term reliability, low power device current stress, low power device voltage stress, low EMI emission level, and soft-switching technique for switching-loss reduction.

For both commercial and residential induction cooking products, the power inverter circuits and the equivalent load modeling circuits and control systems are the two most critical points for the final cost, reliability, and performance of the induction heating product. According to the different application requirements, there are two series of power inverters combined with the control and protection systems to power a variety of induction heated products. The first is the modified half-bridge topology inverter and the second is the modified full-bridge topology inverters.

The design and operating principles, intelligent control functions, and the innovative digitally controlled variable frequency generator of intelligent digital control system of the present invention can be applied to other induction-heating applications and to a multitude of electric appliances, as well.

Figure 1:
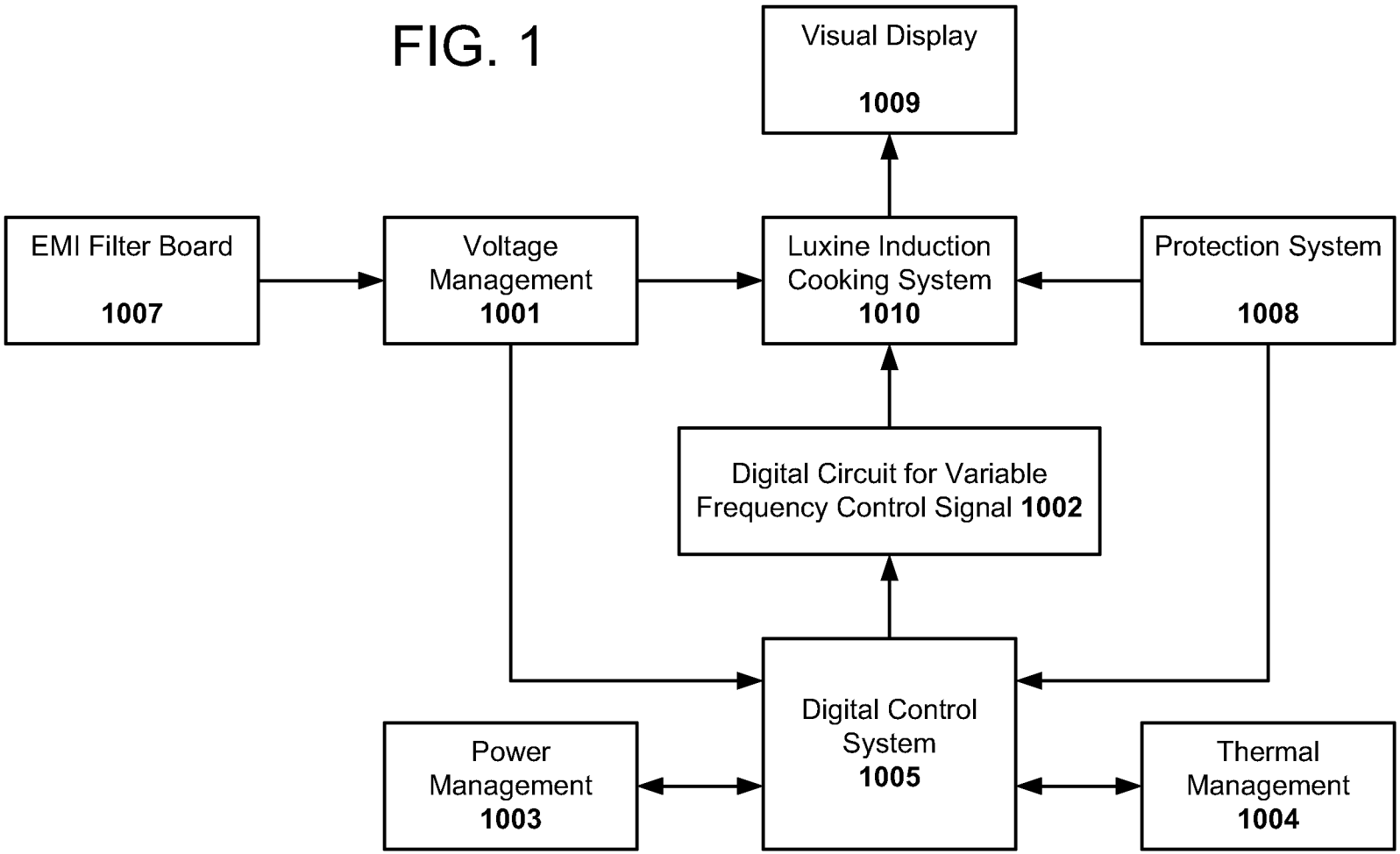
FIG. 1 is a block diagram of the induction heating system of the present invention.
Figure 20:
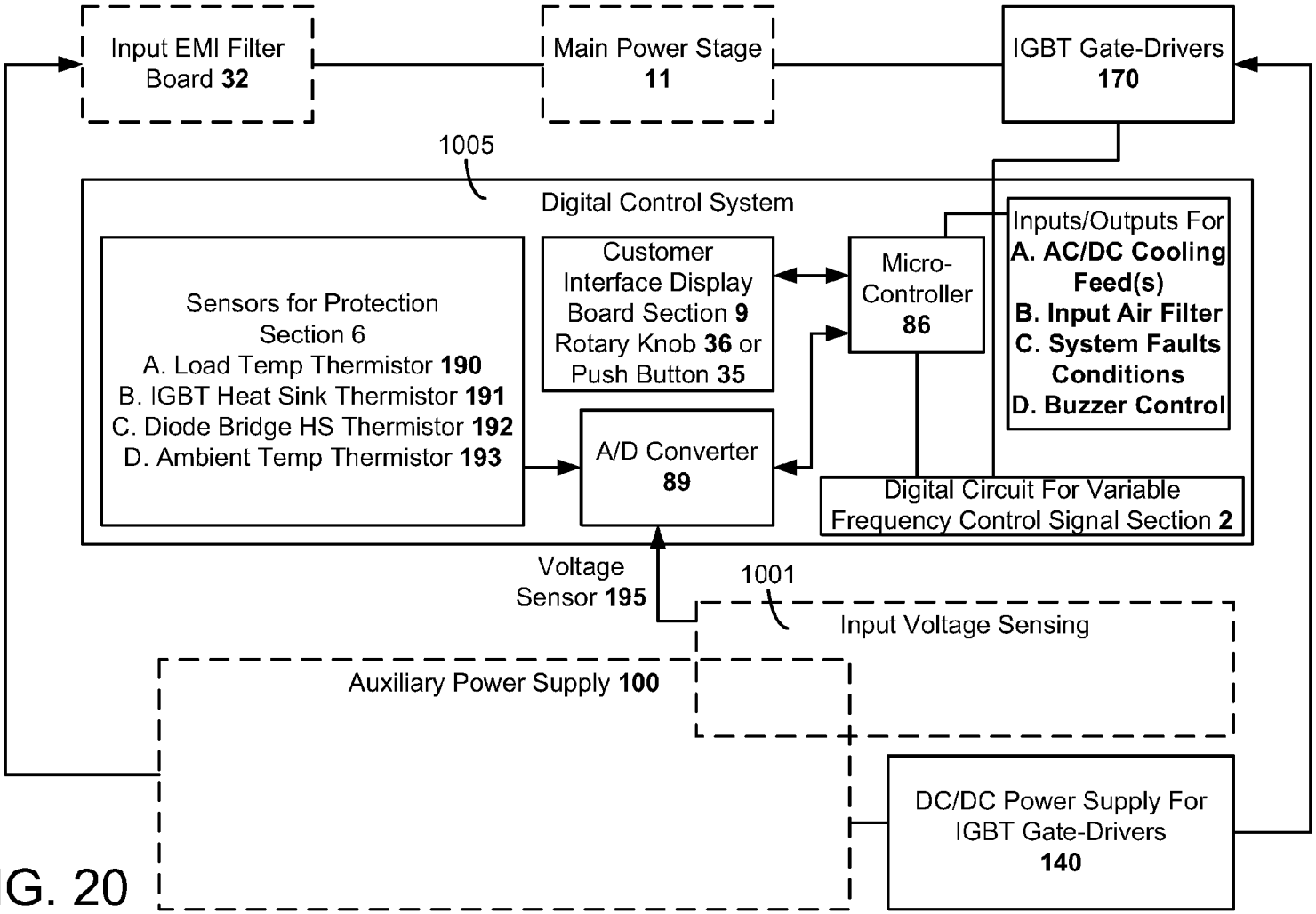
FIG. 20 is a detailed schematic showing the induction heating and control system of the present invention.

Referring now to FIGS. 1 and 20, a system block diagram and a detailed schematic, respectively, for the induction heating system of the present invention are shown. As shown in FIG. 1, an EMI filter 1007 provides an input to voltage management 1001. The voltage management provides an input to induction cooking system 1010. The protection system 1008 also provides an input to the induction cooking system 1010. The voltage management 1001 also provides an input to the digital circuit for variable frequency control signal 1002. The digital circuit for variable frequency control signal provides an input to the induction cooking system 1010. The power management 1003 provides an input to digital control system 1005. Thermal management 1004 provides an input to the digital control system 1005. The digital control system 1005 provides an input to the digital circuit for variable frequency control signal 1002. These systems are discussed in detail below.

It is important to understand that, as used herein, the terms induction heating system and induction cooker are applicable to a wide variety of different induction eating devices, such as but not limited to, induction ranges. Those skilled in the art will appreciate that induction heating may be utilized in various different applications and for various different types of cooking.

Referring now to FIGS. 2 through 7, the induction heating system of the present invention is shown. The induction heating system may comprise either a single induction heating system element or multiple induction heating system elements 1010. The induction heating system elements are enclosed in a metal case 15 and incorporate a ceramic glass top 17.

The micro-controller 86 and digital control system 1005 (FIG. 1) are energized and preferably make a complete diagnostic check of the induction range looking for over temperatures, over voltages, short circuit or other fault conditions. The signals for the diagnostic checks or temperatures are received from sensors 190, 191, 192, 193 of FIG. 20.

Figure 5:
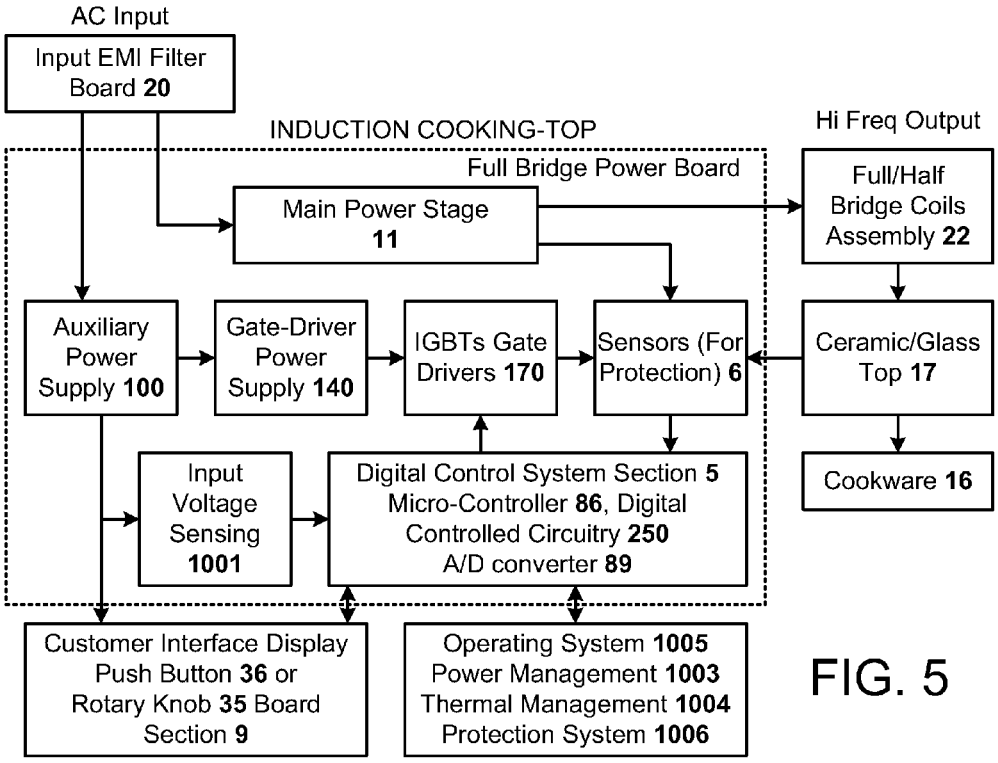
FIG. 5 is a system operation block diagram for the induction heating system.
Figure 6:
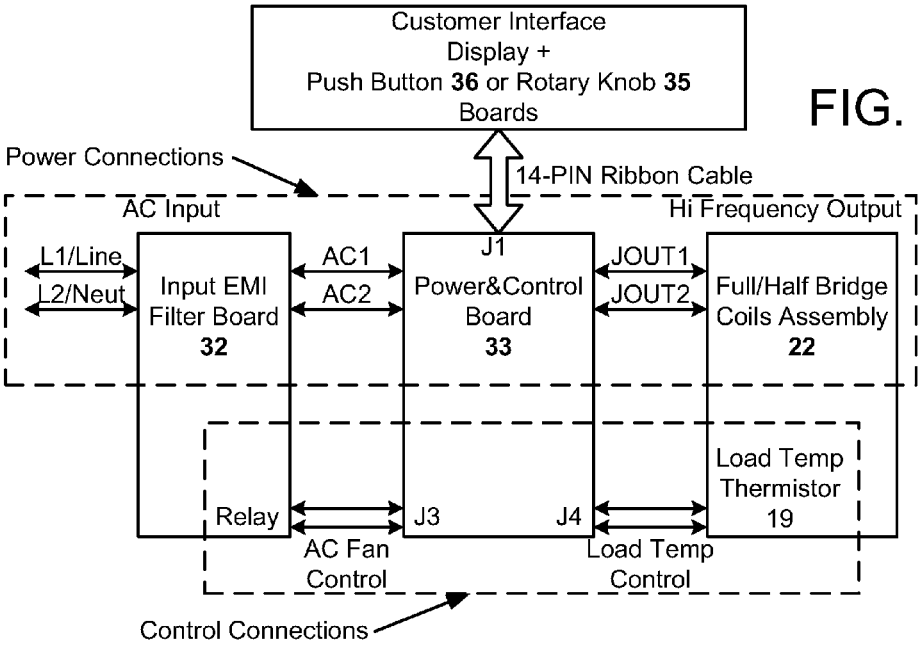
FIG. 6 is a system wiring block diagram of the induction heating system of the present invention.

The input voltage is sensed through a RC network of voltage management 1001 and detected by the ND converter 89 and the power is adjusted to work with this input voltage, as shown in FIGS. 5 and 20 and as described in detail below.

The power is turned on and off by turning a control knob 43 or pushing on the push button 45 or touch control. The rotary knob 43 or the up 49/down 48 push buttons on the display board can adjust the input power setup value.

Figure 2:
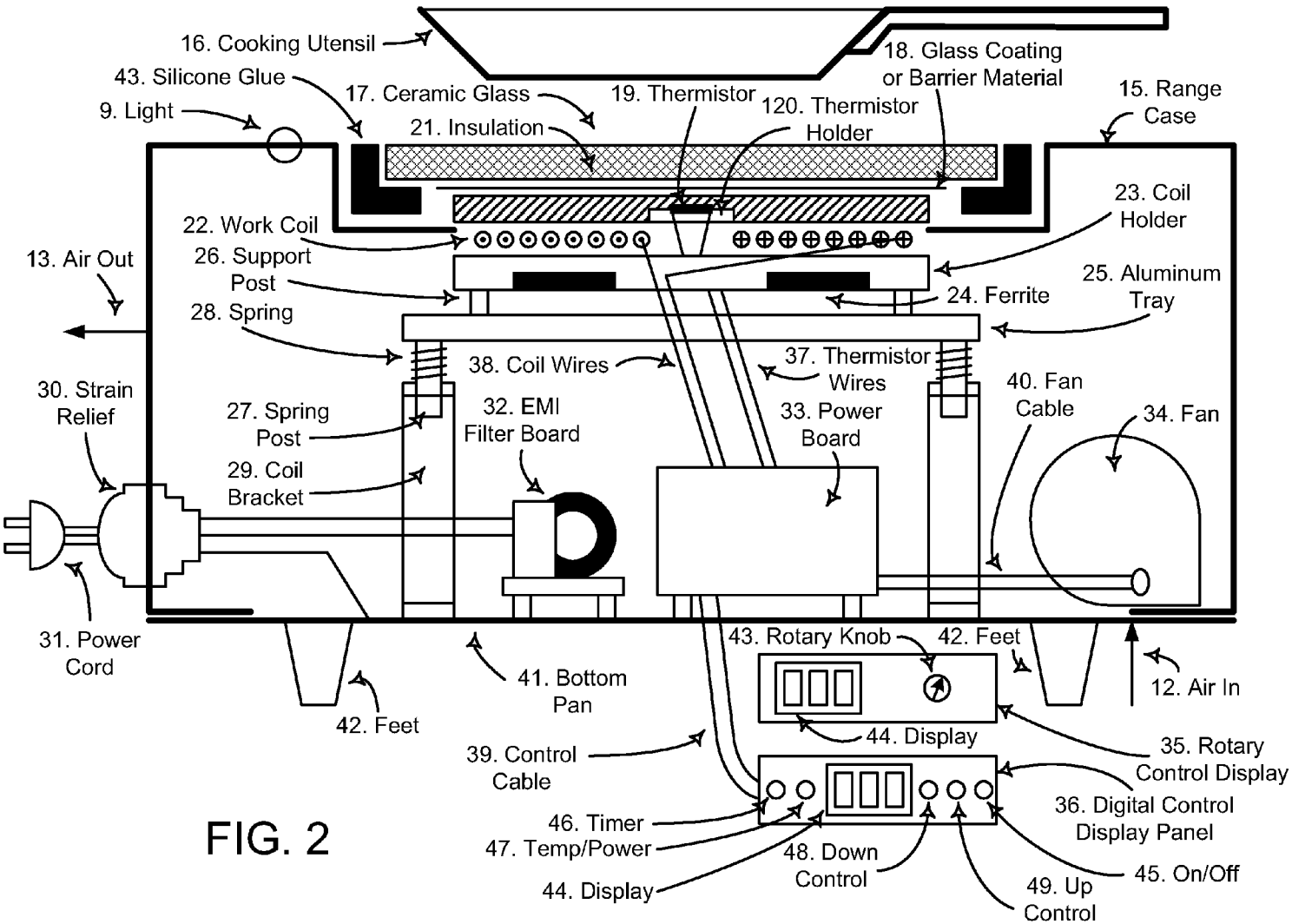
FIG. 2 is a semi-schematic side view of the induction heating system of the present invention.
Figure 3:
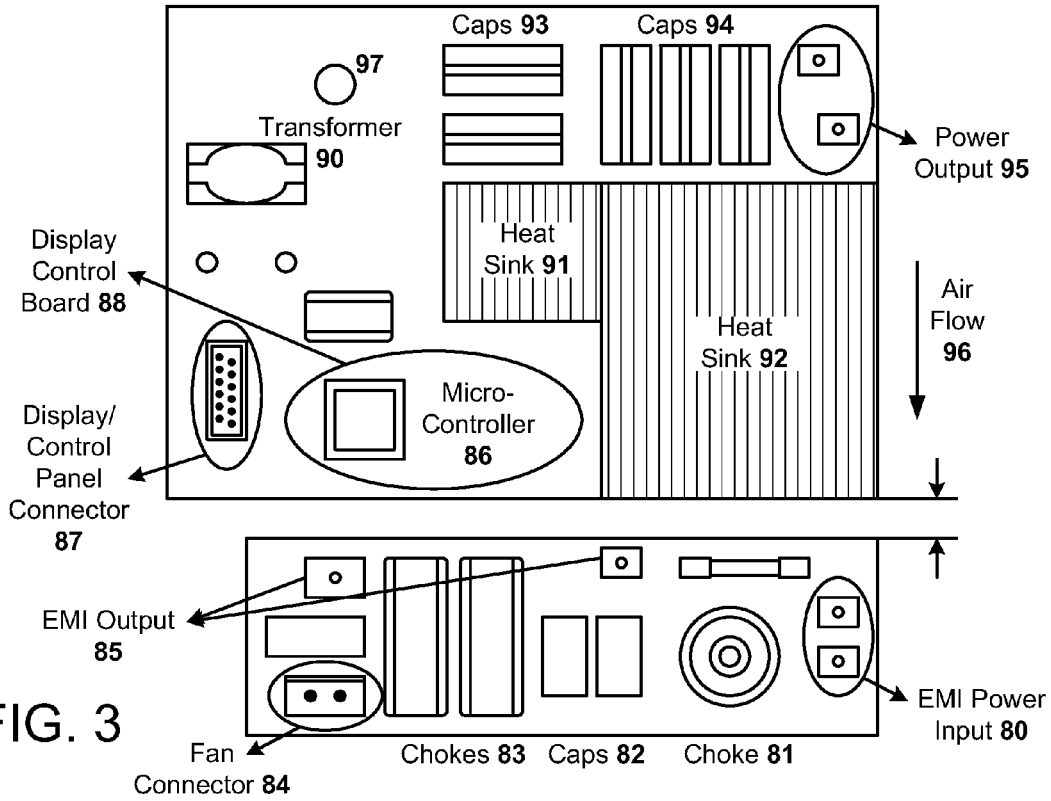
FIG. 3 is a top view of the power and electromagnetic interference (EMI) circuit boards of the induction heating system of the present invention.
Figure 4:
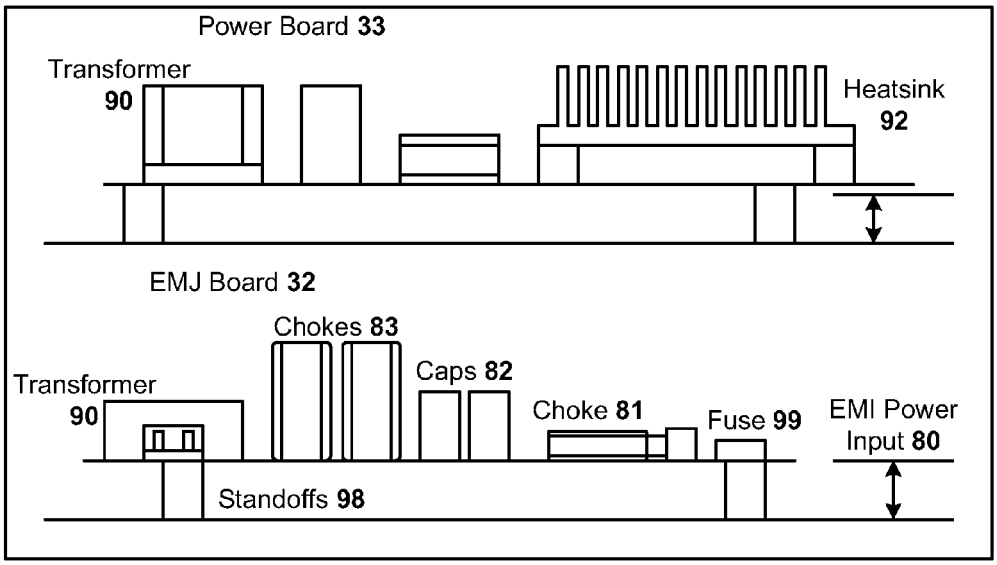
FIG. 4 is a side view of the power and electromagnetic interference (EMI) boards of FIG. 3.

FIG. 2 shows a cooking utensil 16 (heating load) placed on the ceramic cooktop 17. The pan load size and material is analyzed by comparing the ratio of the output current to the input current.

Under the management of the micro-controller 86 in the digital control system 1005, the digital controlled circuitry 1002 generates a square waveform signal with variable frequency and fixed duty ratio. This signal, which controls the resonance frequency of the main power stage 11 (FIG. 5), is used to adjust the output power delivered to the cooking utensil 16.

The output power 225 is delivered to the cooking utensil 16. The heating load is maximized and controlled through the power management 1003 and digital control system 1005 incorporated in the control program of the micro-controller 86 to obtain the maximum safe output power 225 level.

The digital control system 1003, with rotary knob, push button controls or touch controls, allows for sensitive low-end control and sensitive smooth power control.

As the cooking container or utensil 16 (the heating load) increases in temperature over time, the temperature of the ceramic glass top 17 is monitored through thermistor 190, the temperature of heat sinks 91 & 92 are monitored through thermistors 191 & 192, and ambient air temperature is monitored through thermistor 193. As the temperatures approaches the pre-set safe operating temperature limits, the output power to the cooking utensil 16 is automatically limited or reduced. This, in turn, lowers the energy delivered to the cooking utensil 16. It also prevents the monitored temperatures from going up. If the temperatures fall below the safe level, output power is then again increased back to the setup value automatically. Contemporary induction ranges sense the temperature and when the temperature exceeds the upper limit set by the manufacturer, the induction range is turned off completely and does not resume.

For stir fry or sauté cooking, very high temperatures are required. The present invention enables these high temperatures. While cooking at high temperatures, the thermal management 1004 senses if the operator intended to boil water or oil for a long period of time. If boiling water or oil is intended, the temperature of the top plate 17 is limited to 375 to 450 degrees through an auto power management 1003. The intelligent thermal management 1004 can also be used to determine types of cooking and for programmed cooking.

During all cooking operations, the micro-controller 86 continually monitors the values from the temperature sensors 190, 191, 192, and 193 input voltage sensing circuitry 1001, input current sensor 196, and output coil current sensor 194 (FIG. 20). These system-operating readings are compared to pre-set operating values and the micro-controller 86 adjusts the output power to maintain the safe operating conditions for the induction range 10 and maximizing the cooking performance for the operator.

The digital control system 1005 working together with the power management 1003, provides the maximum power output 225 to all pans based on their size and material.

The digital control system 1005 allows for smooth, non jittery movement from one power setting to another and displays the input power setup value in percentage of maximum unit rating power. A smooth step from one digit to the next of the digital readout 44 on the digital display of rotary control display 35 or the push button display 36 is achieved by the use of rotary knob 43, push buttons 48 & 49 or touch control.

The power management 1003 allows better use of the maximum input branch circuit amperage and maximum plug rating. Utilizing the maximum branch circuit power rating and the maximum plug/receptacle ampere rating enables the maximum power for a dual-element heating range. For example in UL-197 (page 27), UL currently requires that the current rating of attachment plug of an appliance rated more than 15 amperes, shall not be less than 125 percent of the maximum current input of the appliance when tested in accordance with the Power Input Test. The exception for this is that the attachment plug may be rated not less than the current and voltage rating of the appliance if, when operated continuously for at least 3 hours with no food load or as described for the normal temperature test, the average current input to the appliance is 80 percent or less of the capacity of a branch circuit equal to or higher than the nameplate. This invention allows the maximum usage over a variable amount of time on a 30-amp power cord and plug/receptacle.

When the cooking utensil 16 is removed from the ceramic top 17, the digital control system 1005 can sense the removal of the cooking utensil. Then the output power is reduced automatically. When the cooking utensil is replaced back onto the ceramic top 17 within a specified period of time, the output power resumes at the preset level.

The heating system 1010 of the present invention is designed so that it will not stop heating under normal cooking conditions. If the ceramic top 17 gets too hot, the power to the work coil 22 is reduced to allow the temperature to stay in the predetermined safe range and the cooking in the cooking utensil 16 will continue.

When the cooking utensil 16 is removed and not put back on the cooking surface 17 within a specified period of time then the induction cooking range or other heating appliance will turn off.

When the induction range 10 is turned off by pressing the on/off button 45 or turning the control knob 43 to the "off" position, the output power 225 to the cooking utensil 16 will go off and the cooling fan 34 will continue to operate for 3 more minutes or the time specified in the digital control system section 1005.

The digital control system section 1005 together with the protection system section 1008 are constantly checking the sensors 190, 191, 192, 193, 194, 195, 196 (FIG. 20) for safe operating conditions and long term reliability.

The EMI noise is minimized through EMI filter circuit 32 to meet the FCC-18 standard.

To protect the work coil 22, the EMI board 32 and the power board 33 and other electronic wiring from water spill caused by a broken ceramic top 17, a rubber or silicone coating of the under side of the ceramic top plate or barrier sheet 18 can be placed between the electronic circuitry 22, 32 & 33 and the ceramic glass top 17. Preferably, the rubber or silicon coating 18 forms a sheet which adheres to the bottom surface of the ceramic top 17. Alternatively, the barrier sheet 18 may define a totally separate structure with respect to the ceramic top 17. Indeed, according to the present invention, any desired barrier may be utilized so as to inhibit the flow of liquids from a broken ceramic top 17 to electronic circuitry of the induction cooker.

The ceramic glass top 17 is lit up with a variable light source 9 to indicate the relative level of heating power. This is a user-friendly display indicating the power level. Preferably, the light is configured so as to somewhat mimic a gas flame or an electrical burner element, in that the light illuminates brighter as induction power increases. As those skilled in the art will appreciate, the light thus provides a readily visible indication of the power presently being used for cooking, much in the same fashion that the height of a flame for a gas range indicates the amount of heat being applied.

Preferably, light source 9 is disposed below the ceramic glass 17, such that the ceramic glass glows when the light illuminates. Alternatively, the light source 9 is disposed next to the ceramic glass, as show in FIG. 2.

This invention is related to the performance and reliability enhancement of a variable frequency controlled resonant converter for output control and system performance.

The induction heating system for appliances is a sophisticated, intelligent system for thermal, electrical, magnetic and environmental monitoring, regulation and control for optimum performance and reliability. The overall system operates and achieves its high performance and reliability through the interaction and interrelationships of the individual sections.

Voltage Management 1001 (FIG. 1) facilitates voltage sensing and enabling operation of power circuitry.

Digital circuit for variable frequency control signal 1002 provides digital controlled circuit and hardware design with interface to a micro-controller to generate a square waveform with a wide frequency range with small, smooth resolution. This circuit provides a comprehensive way to generate a square waveform with variable frequency and a combination of selectable steps or variable duty ratio by binary variables and thereby, provides an effective way and interface for digital control. The operating principle of this circuit can be applied to other circuits to generate every kind of waveform, such as sinusoidal, saw-tooth, triangle, etc. which can be represented by frequency and duty ratio. This circuit can be used for many applications such as motor controls and many other applications.

This circuit is used in the induction power supply to generate the integrated gate bipolar transistor (IGBT) gate-driver control signal for the resonant power stage. This, together with full and half bridge resonant circuitry, provides a unique combination.

Power management 1003 facilitates efficient power usage. Pan size and material sensing adjusts the output power to the maximum level for safe operating conditions. Constant output power control is provided for different loads. By automatically sensing the size and the material of the load and then the output power is adjusted to the maximum safe level for the induction range. Maximum power usage is facilitated by utilization of the maximum branch circuit amperage and maximum plug circuit amperage. When the pan is removed the circuit detects the removal of the pan and no power is provided. When the pan is replaced within a specified period, the heating resumes at the preset level. The power is adjusted to maintain safe operating conditions of the range and to maintain cooking under normal conditions. When the pin is removed and not put back on the cooking surface within a specified period of time the range will turn off. Protection systems are provided for power management section 1003.

Thermal management and temperature limit control is provided for the ceramic top plate, internal electric heat sinks and ambient temperatures. The thermal management system 1004 senses and measures temperature points on ceramic glass top 17, heat sinks 91 and 92 and ambient air temperatures. The sensed temperatures are preferably compared to programmed operating ranges and power output levels are regulated to adjust and maintain safe operating temperatures for the cooking utensil 16, the ceramic top plate 17 and the internal electronics.

High temperature cooking is facilitated by allowing the cooking utensil 16 to exceed the normal regulating temperature point of the ceramic glass top 17 in order to provide high temperatures for stir fry and saute cooking. Cooking is allowed for a predetermined period of time, and then the power is automatically reduced if there have been no other changes in the control input system. This system predicts if a person is intending to boil water or oil for a longer period of time and then after the initial 5 minute heat up time, will automatically reduce the output power to maintain a pan temperature not exceeding 400 to 450 degrees Fahrenheit.

The present invention provides an intelligent thermal control system. During all cooking operations, the micro-controller is continually monitoring many different sensors including, over temperatures, over voltage, over current. These input readings are compared to preprogrammed operating values and the micro-controller then adjusts the operating power to maintain the safe operating conditions for the induction range and maximizing the cooking performance for the operator.

Intelligent digital operating control systems 1005 provide low end power control and smooth power control. Digital control system facilitates low-end power control. Digital control system facilitates smooth power control. Smooth digital LED display of output power is provided. Using a potentiometer and knob, a smooth step-by-step number is displayed showing the percentage of output power or other value desired by OEM account. The fan continues to run when power turned off for preset time. When the range is turned off by pressing the off button or turning the control knob to off, the power to the pan will go off and the cooking fan will continue to operate for 3 minutes or the time specified by the OEM account.

Intelligent protection system strategies are provided for high reliability, long term circuit operation. Each of the building block sections (each box shown in FIG. 1) detailed for the induction range is self-regulating and self-protecting. Each section stands alone in its ability to communicate to the other sections and to monitor its operation to provide protection and enable its safe operation.

The core of these protection functions is the micro-controller. The digital control system 1005 monitors input voltages, currents and temperatures at high rate and compares them to safe operating criteria. Should any inputs be out of spec, then the microcontroller adjusts and regulates the operating voltage, output current to maintain safe and reliable operating conditions to provide a high reliability, "bullet proof", power supply.

An EMI filter 1007 is designed for low EMI filter emissions.

Circuitry and system protection from a cracked ceramic top is provided. Rubber or high temperature silicone coating is provided on underside of ceramic glass such that it will seal any cracks in the ceramic glass and keep any liquid from entering the electronics compartment. One alternative to coating of the glass is the use of a separate barrier material, such as rubber, silicone or high temperature thermoplastic material to seal the ceramic top plate from the electronic compartment. Another alternative to cooking of the glass is to provide high temperature thermoplastic material that will not break under impact and replace ceramic glass tops with this material.

A visual display of heating power is provided. A variable light source constructed from any available incandescent, light emitting diode, fluorescent, neon or other light source that is varied in intensity and transmitted through the translucent ceramic glass top to show a relative indication of the power level. A visual indication to the user, covering a wide and general area of the cooking surface indicating the Surface of the pan being heated.

Blink rate, slow to fast and then steady to indicate output power level is an optional form to show power.

Figure 7:
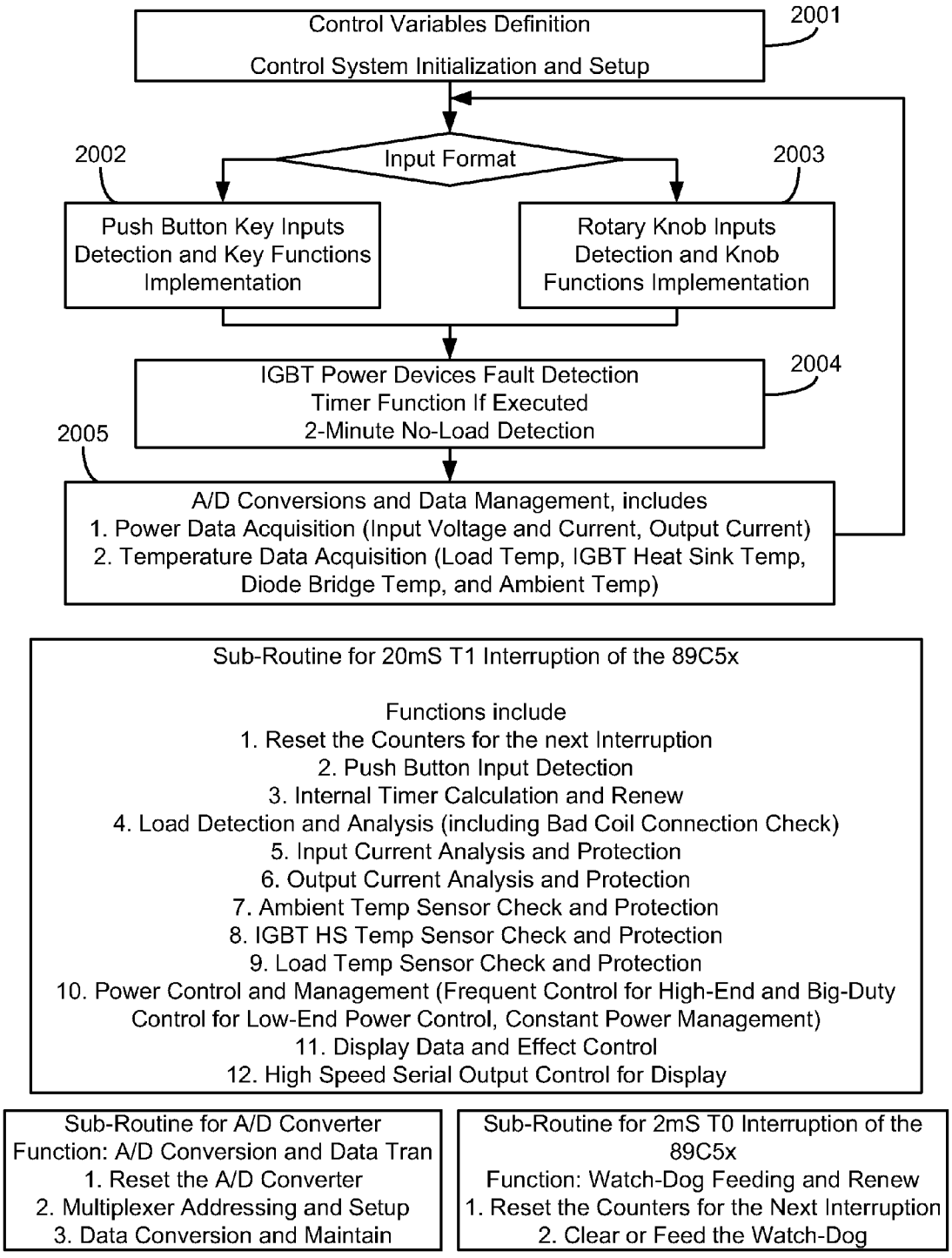
FIG. 7 is a system control program flow chart for the induction heating system of the present invention.

Referring now to FIG. 7, the induction cooking system control program flow chart for the present invention as shown. Control variables are defined and the control system initialization and set-up is performed, as shown in block 2001. Input formatting is performed by either push button key inputs detection and key functions implementation as shown in block 2002 or rotary knob inputs detection and knob functions implementation as shown in block 2003. IGBT power devices fault protection is provided and timer functions are provide, if executed. Two-minute load detection shuts down heating if no load is detected within two minutes, as shown in block 2004.

A/D conversions and data management include power data acquisition (input voltage and current, output current) and temperature data acquisition (load temperature, IGBT heat sink temperature, diode bridge temperature and ambient temperature, as shown in 2005.

Induction cookers have traditionally been designed for a specific AC line input voltage; for examples, 208VAC+10% or 240VAC+10%. Thus the same cooker cannot be used at full load for both voltages. This imposes a large cost penalty on both manufacturers and distributors because of the requirement to build and distribute two different models of very similar cookers, one model for each specified input line voltage. If a cost effective method could be found for detecting the input line voltage and using that in a feedback circuit to adjust the power level, then it would be possible to use the same model cooker for both 208 VAC and 240 VAC. A search for an inexpensive AC line detection circuit and feedback control scheme was initiated. The goal was to find some scheme that would not add any power components nor add an additional winding to the flyback housekeeping supply inside the cooker.

The disclosed AC line voltage detection circuit allows an indication of the AC line voltage to be made from looking at the secondary of the flyback transformer in the housekeeping auxiliary power supply for the induction cooker. The peak negative voltage seen across the secondary winding of the flyback transformer during the PWM pulse time is rectified and stored on a capacitor. A voltage divider connected between the negative voltage on this capacitor and an existing regulated positive voltage from a 3-terminal regulator provides positive voltage to a spare A/D converter for input to a microprocessor. Adjustment of a potentiometer in the voltage divider improves the accuracy of the voltage detection. The potentiometer compensates for errors due to the tolerance of the two other resistors in the voltage divider, and the regulated voltage applied to the voltage divider and the voltage tolerance of the reference voltage input to the microprocessor.

No examples of a voltage detection circuitry were found among competing induction cookers but there are a number of AC line detection circuits used in off-line computer power supplies, two examples of which are discussed below.

Figure 8:
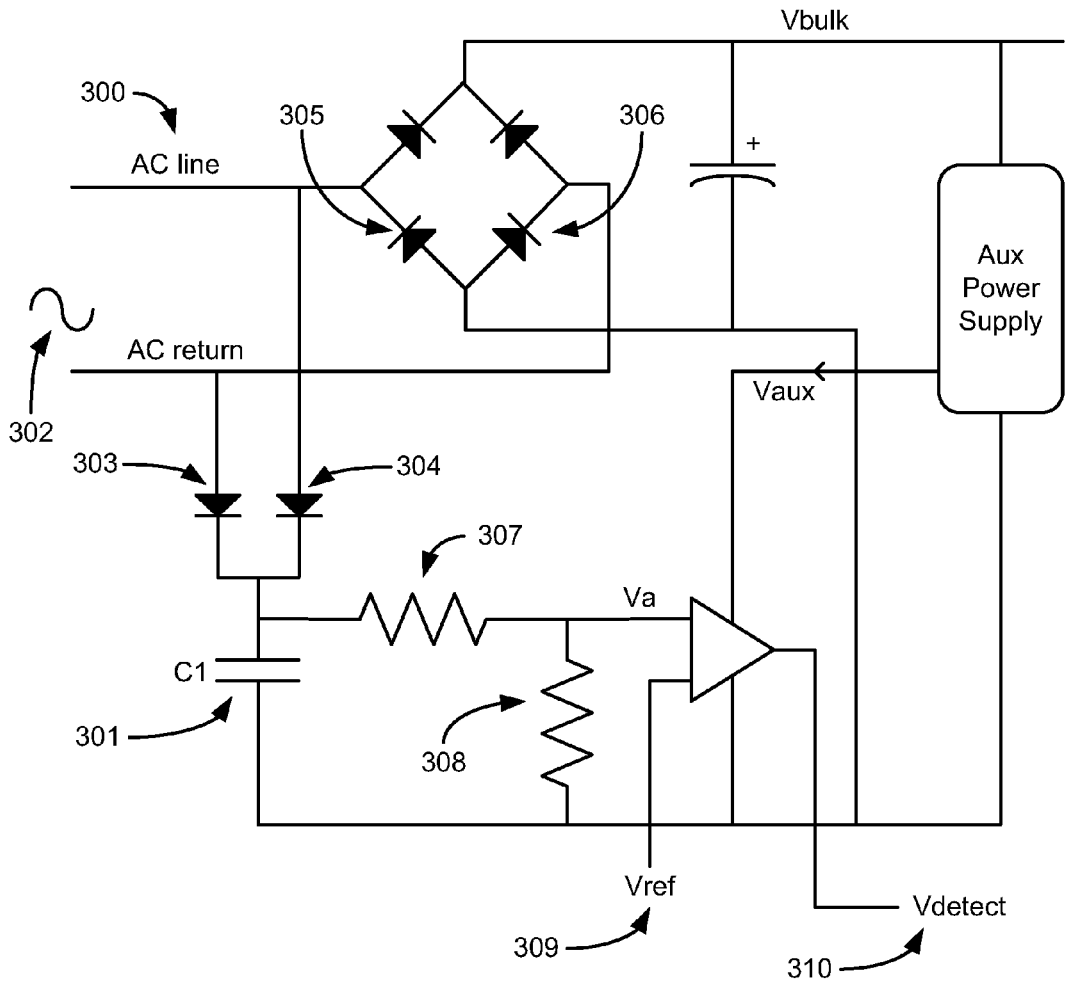
FIG. 8 Prior Art
FIG. 8 is an exemplary prior art power-factor-corrected power supply used to detect an AC line under-voltage condition according to the prior art.

FIG. 8 shows a circuit typically used in power-factor-corrected supplies to detect a AC line 300 under-voltage condition lasting more than a few tens of milliseconds. In it, capacitor 301 is charged to the peak voltage of the AC waveform 302 via diode 303 and diode 304. Return path for capacitor 301 charge current is via diode 305 and diode 306. This peak voltage is divided down by voltage divider resistors 307 and 308, then compared with Vref 309. If Vdetect 310 is too low, then the PFC boost circuitry is shut down.

This AC line voltage detection approach was rejected for the induction cooker for three reasons:

1) A primary auxiliary voltage and reference voltage are needed;

2) There was no comparator in the existing primary circuitry; and

3) An opto-coupler would be needed to transfer the voltage detection information to the secondary where the information is needed for the cooker's power control circuitry.

Figure 9:
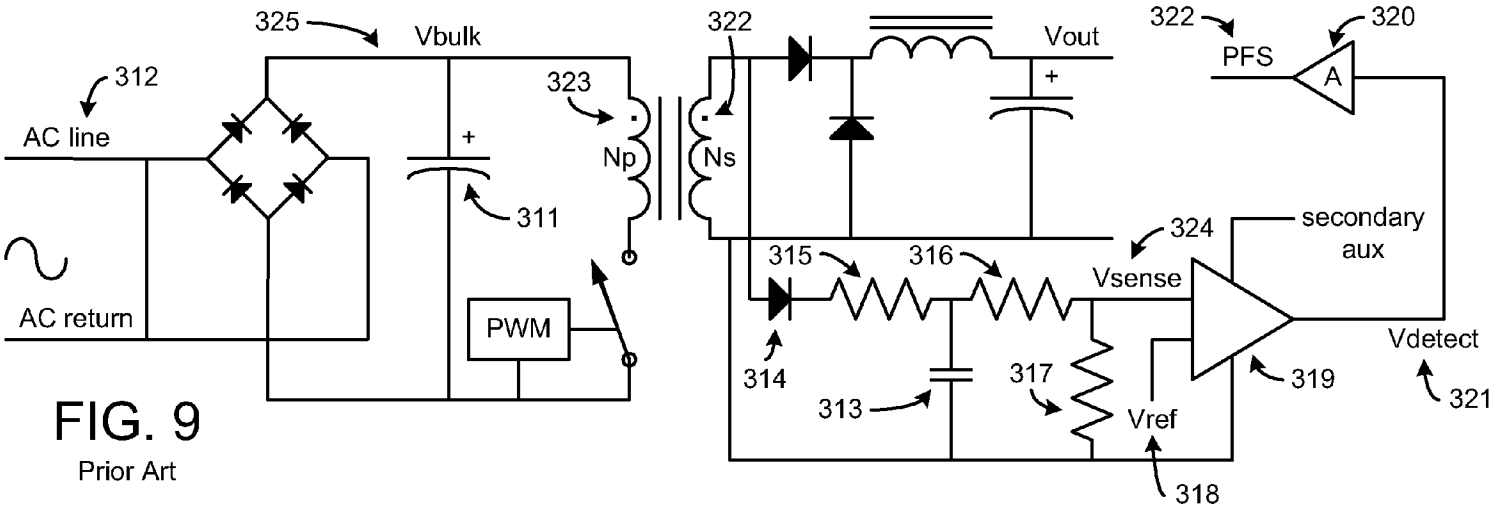
FIG. 9 Prior Art
FIG. 9 is an exemplary prior art voltage detection system, which is used to generate a power fail signal in a switching power Supply of a buck generator.

FIG. 9 shows another voltage detection circuit that is widely used to generate a power fail signal in a switching power supply of a buck regulator. Capacitor 311 is charged to about 1.4 times the RMS value of AC line input voltage 312. During each pulse, capacitor 311 is charged through diode 314 and small value resistor 315 to Vbulk 325 times the transformer turns ratio, Ns 322/Np 323. Voltage divider resistors 316 and 317 divide down the voltage across capacitor 313 and the resulting voltage is compared with reference voltage Vref 318. When Vsense 324 drops below the value of Vref 318, the output of the comparator 319 is input to a current amplifier 320 that issues a power-fail signal 322 to give a computer a warning signal that the AC line voltage 323 is too low to support voltage regulation for more than about 1-to-5 more milliseconds.

This circuit approach was rejected for the induction cooker application for two reasons:

(1) The auxiliary supply inside the induction cooker is a flyback, not a buck regulator. To use the scheme described above would require another secondary winding to be added to the flyback transformer; and (2) No spare comparator or op-amp gate was available for the comparison with the reference voltage Vref 318 of FIG. 9.

Figure 10:
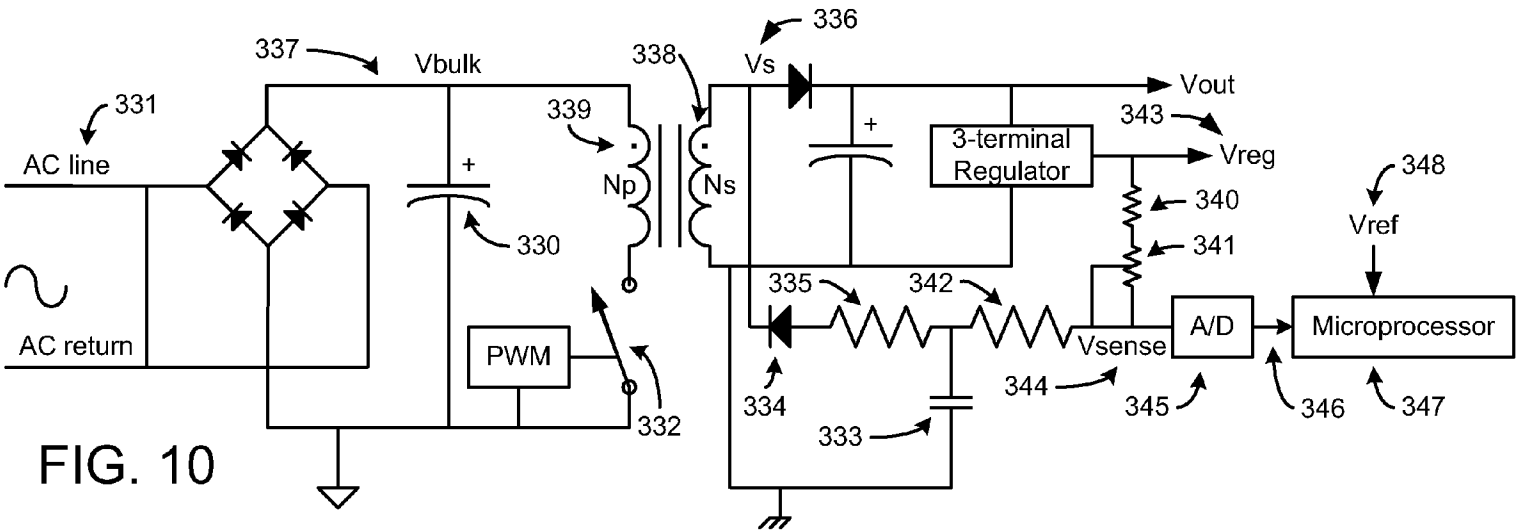
FIG. 10 is circuit for detecting AC line voltage by sensing the peak negative voltage across the secondary winding of a flyback transformer during pulse width modulation (PWM) pulse time, according to the present invention.

FIG. 10 shows the new circuit of the present invention. In this circuit, V bulk 337, the voltage across capacitor 330 is charged to about 1.4 times the RMS value of the input AC voltage 331. When the primary switch, 332, in the flyback supply is closed, capacitor 333 charges through diode 334 and small value resistor 335 to a negative voltage equal to Vs 336 minus the diode voltage drop across diode 334. The Vs voltage 336 in turn is approximately equal to Vbulk 337, the voltage across capacitor 330 times the turns ratio of the transformer, Ns/Np 338/339. Voltage divider resistors 340, 341 and 342 connected between capacitor 333 and a regulated voltage Vreg 343 cause a positive voltage, Vsense 344 to be present at the input to an ND converter 345. The hexadecimal output of the A/D 346 is input into a microprocessor 347. There the hexadecimal output is compared to that of a master reference voltage 348 and used to generate a display number for the test operator that corresponds to the value of Vsense 344 and thus to the RMS value of the input AC line voltage waveform 331.

Figure 11:
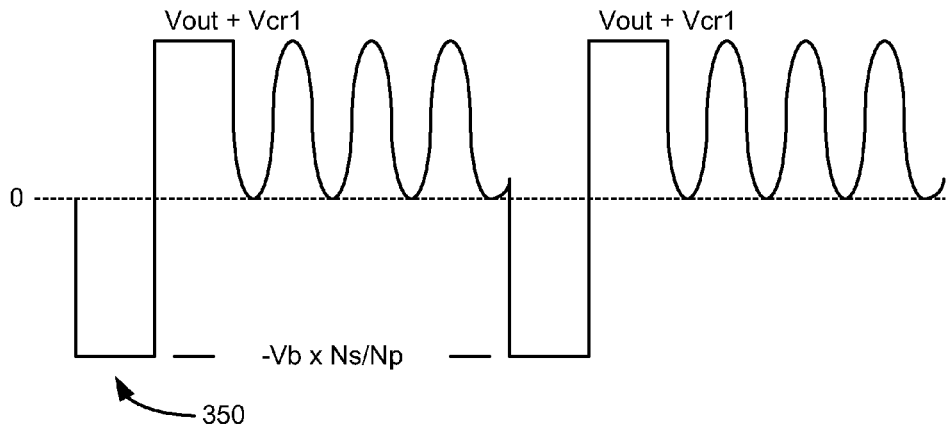
FIG. 11 is a typical waveform for Vs, as seen across the secondary winding of the flyback transformer of the circuit shown in FIG. 10.

FIG. 11 is a typical waveform for Vs 336 seen across the secondary of the flyback transformer in the circuit of FIG. 10. It is the most negative voltage 350 shown in the waveform of FIG. 11 that is rectified by diode 334 in FIG. 10 and made to appear across capacitor 333 in FIG. 10.

Figure 12:
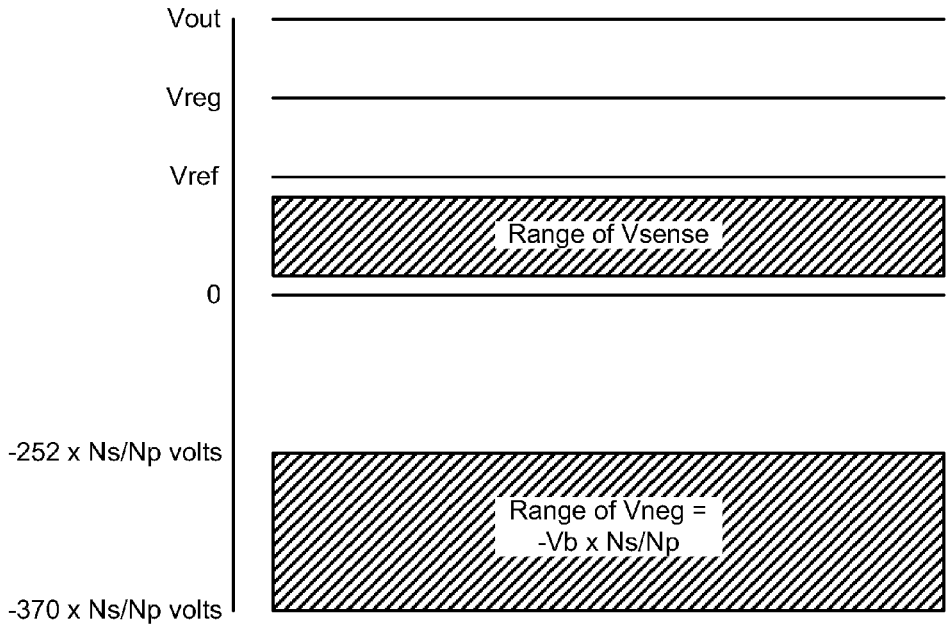
FIG. 12 shows the relative range of Vsense and the negative voltage across the capacitor of FIG. 10.

FIG. 12 shows the relative range of Vsense 344 and the negative voltage across capacitor 333 in circuit of FIG. 10. The range of the most negative voltage 350 in FIG. 11 is approximately the negative peak voltage of the AC input waveform divided by the turns ratio of the flyback transformer. For AC line voltages between 180 VAC and 264 VAC, negative voltage 350 will typically vary between minus 252 volts and minus 370 volts times the turns ratio of the flyback transformer. The range of Vsense must lie between zero volts and the master reference voltage applied to the microprocessor. The values of voltage divider resistors 340 and 342 of FIG. 10 must be carefully chosen to ensure that Vsense does not during normal operation of the cooker go above the reference voltage, Vref, nor below zero. To have good sensitivity, the ratio of the voltage divider resistors should be as high as permitted without having Vsense fall outside the permissible range between Vref and zero volts.

There are a large number of component tolerances that effect the accuracy of the correlation of the final microprocessor code to the actual RMS voltage. The principal circuit tolerances are those of the resistors in the voltage divider, the tolerance of Vreg and the tolerance of Vref. However, good accuracy within a limited range of AC input voltages can be ensured by addition of potentiometer 341 and using a test procedure to adjust its resistance value. The test operator inputs a known AC RMS voltage to the unit and adjusts potentiometer 341 until the microprocessor display outputs the correct number that should correspond to that AC line voltage. The AC line voltage detector circuit has then been calibrated. The output of the microprocessor then can be used in a variety of control schemes not discussed above, to be the subject of additional disclosures.

Circuit design generates a square waveform with a wide frequency range with small, smooth resolution. Digital controlled circuit provides square waveform with variable frequency. This circuit provides a comprehensive way to generate a square waveform with variable frequency and variable duty ratio by binary variables and thereby, provides an effective way for digital control. The operating principle of this circuit can be applied to other circuits to generate every kind of waveform, such as sinusoidal, sawtooth, triangle, etc. which can be represented by frequency and duty ratio. This circuit has application to many other products, such as motor controls.

As those skilled in the art will appreciate, the digitally controlled oscillator may alternatively be used to generate any other desired periodic waveform, such as sawtooth, triangular, sinusoidal, etc.

The digital controlled circuit of the present invention generates a square waveform with variable frequency and variable duty ratio in a wide range and with small resolution steps.

The present invention is related to an innovative circuit that is used to generate a square waveform in a wide frequency range with small resolution. Both the frequency and the duty ratio of the output square waveform can be changed with small step from low-end to high-end. The number of total frequency steps and duty ratio steps can be increased with no limitation and each step is associated with one binary variable. Only resistor and/or capacitor networks with certain value combination are needed in this circuit to extend or move the frequency and duty ratio range. So this circuit provides a comprehensive way to generate a square waveform with variable frequency and variable duty ratio by binary variables. Thereafter it provides an effective way for digital control. The switching mode power supply where the variable frequency and duty ratio waveforms are needed and controlled by microcomputer is one of the examples.

The operating principle of this circuit can apply to other circuits to generate every kind of waveform, for example sinusoidal, sawtooth, triangle, etc., which can be represented by frequency and duty ratio. This circuit has application to many other products, such as motor controls.

Normally in switching mode power supply, electromagnetic interference (EMI) has become a major problem for control circuit designer and it is likely to become more and more severe. This brings a great challenge for the design of the adjacent circuit. In order to operate correctly, all the adjacent circuits must be immune to every kind of noise. One major advantage of digital circuit is that it has a good noise capability. This makes it very suitable for control in switching power supply. Induction heating product utilizes the resonant converter technology to generate a pulsating magnetic field to transfer energy. To control the output power of the resonant converter circuit, a square waveform with variable frequency and variable duty ratio is needed. The circuit of this invention is used in the induction-heating product and the results are very satisfied.

A circuit for digitally controlling a variable resistor facilitates variable frequency and/or duty cycle control over a wide range and in arbitrarily small steps.

Figure 13:
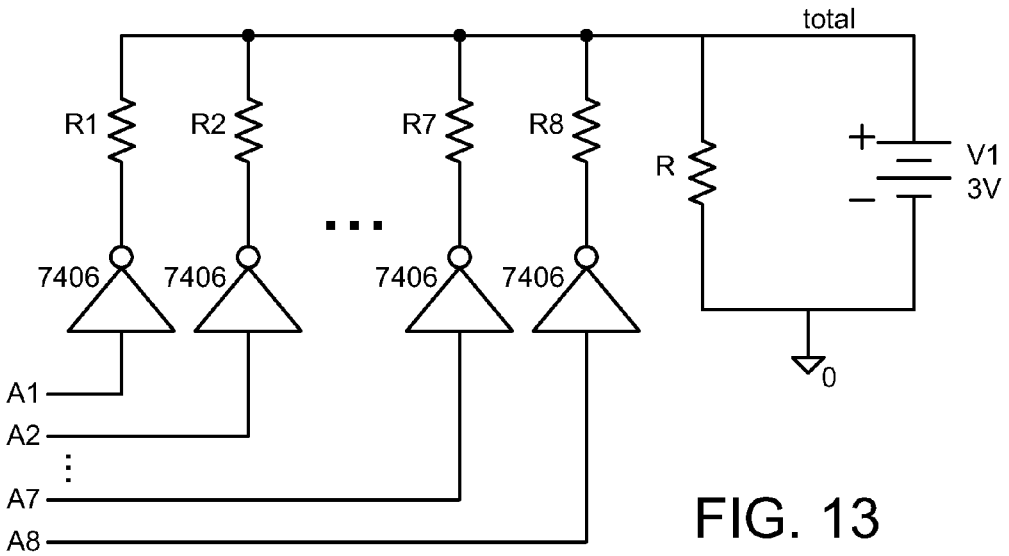
FIG. 13 is a schematic diagram showing a circuit for a digitally controlled variable resistor according to the present invention.

Referring now to FIG. 13, the circuit for providing a variable resistor is shown. In the circuit the value of R1 is twice of R, the value of R2 is twice of R1, . . . and R8 is twice of R7, so $$R8=256R$$

where R has no value limitation. If all the input of 7406s are low, then the equivalent resistance on the left side of the DC voltage source is just R. If only A1 is high, the equivalent resistance is R in parallel with R1. Here we ignore the voltage drop of the transistor in output section of 7406. Actually other equivalent circuitry can replace 7406.

Figure 14:
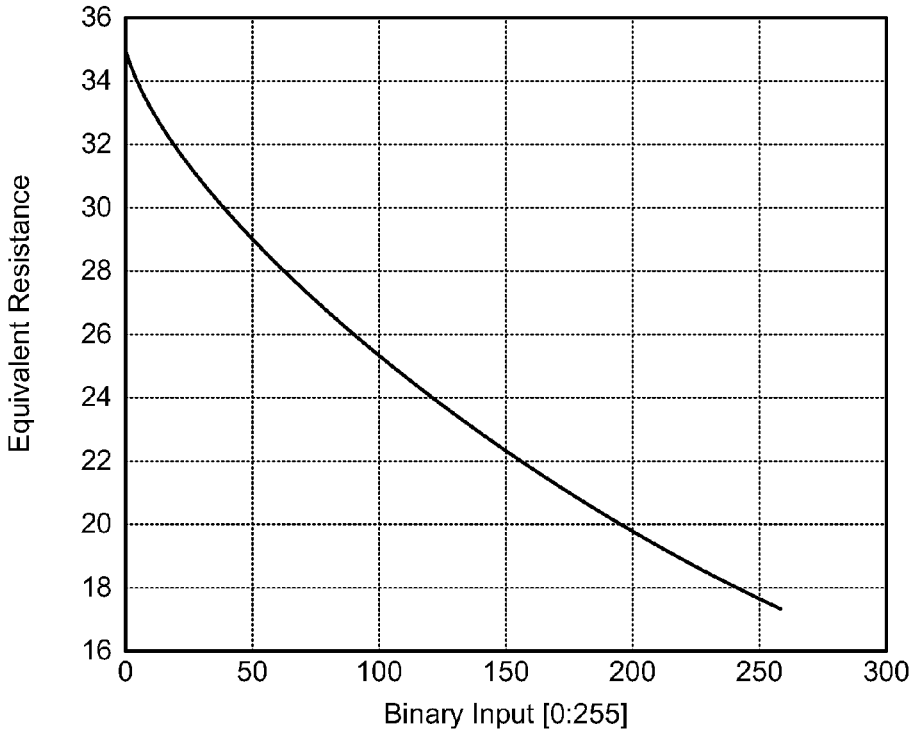
FIG. 14 is a graph showing the equivalent resistance versus corresponding input binary variable for the digitally controlled variable resistor of FIG. 13.
Figure 15:
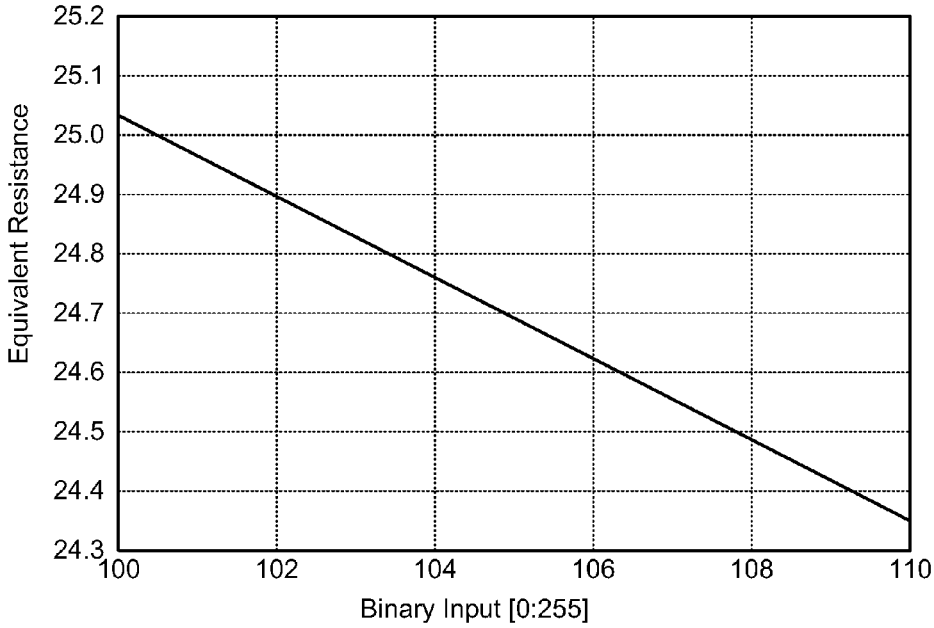
FIG. 15 is a chart showing more detailed (greater resolution) information regarding the equivalent resistance versus input binary variable of FIG. 14.

FIG. 14 shows the equivalent resistance when binary variable A1A2 . . . A7A8 changes from 00H to 0FFH. Here R is 34.8 Kohm. From FIG. 14 we can see that the equivalent resistance is one to one corresponding to the input binary value A1A2 . . . A7A8. Also FIG. 15 shows the equivalent resistance when input binary variable changes only from 100 to 110. On FIG. 15 the maximum difference between each step is about 0.11 Kohm. Actually the difference between every step can be reduced without limitation if more resistors are added to the circuit in FIG. 13. Also, if different combination of R, R1, . . . R8 or even more is used, the equivalent resistance can change in a wide range with small resolution step.

In FIG. 13 it is clear that the total current out of the DC voltage source, note!, is $$I\text{total}=V1/R\text{eqivalent}$$

where V1 is the output voltage of the DC voltage source. In this example it is 3 volts.

Provided below is a detailed description of the operation principles of SG3524 and equivalent points.

The circuit shown in this part does not belong to this invention. The information given here is to help understand how to use the invented circuit described above.

Figure 16:
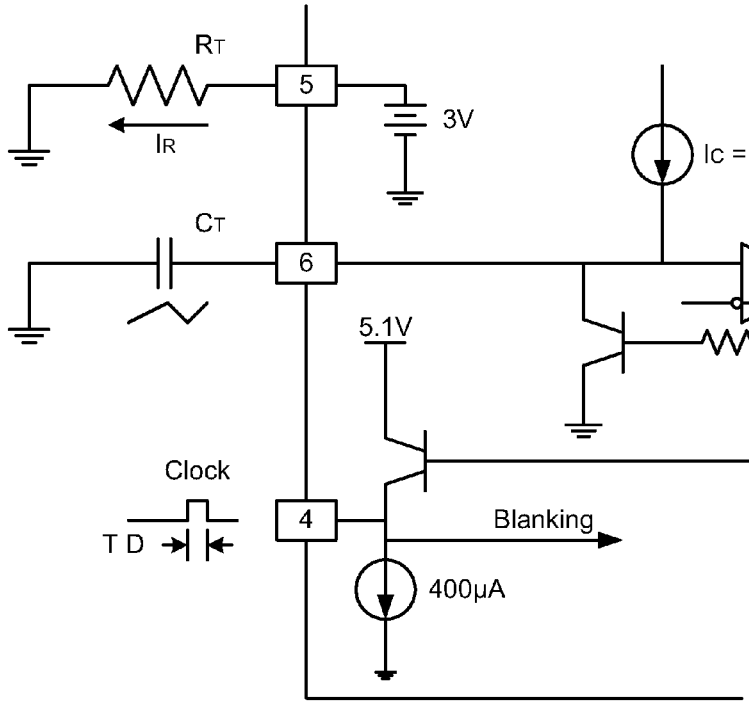
FIG. 16 Prior Art
FIG. 16 is a schematic diagram showing a simplified prior art oscillator circuit.

FIG. 16 shows a simplified oscillator circuit used in most pulse-width modulators for switching mode power supply. This oscillator is used to generate a fixed frequency signal programmed by the timing resistor Rt and the timing capacitor Ct. Rt establishes a constant charging current Ir. The current of the current source IC is equal to Ir, so $$Ic=Ir$$

The current source Ic charges the timing capacitor Ct and results in a linear voltage ramp across Ct which is fed to the comparator providing linear control of the output pulse duration (width) by the error amplifier. The frequency of this oscillator, f, is $$f=1.30/(Rt*Ct)$$

where Rt is in kohmns, Ct is in uF, f is in kHz. Detail information about other oscillators can be available from the data-sheet of those pulse-width modulators.

Figure 17:
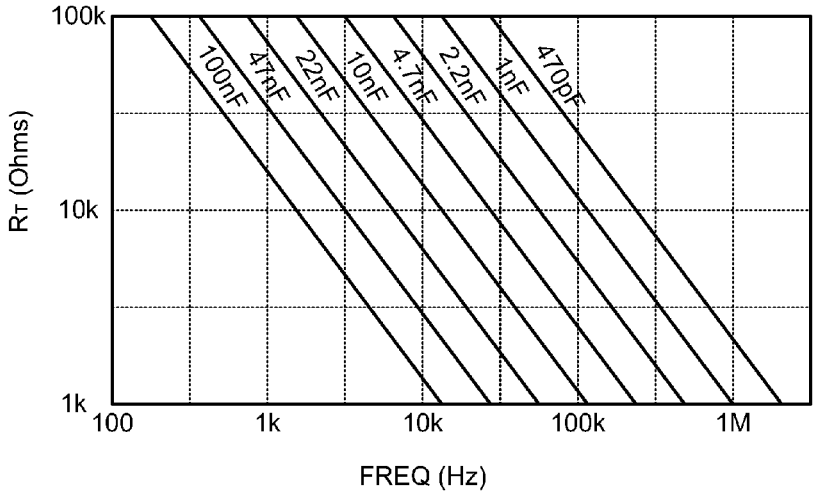
FIG. 17 is a chart showing timing resistance versus frequency for the oscillator circuit of FIG. 16.

FIG. 17 shows the timing resistance vs. frequency.

Provided below is a detailed description of the combined circuits for the present invention.

Figure 18:
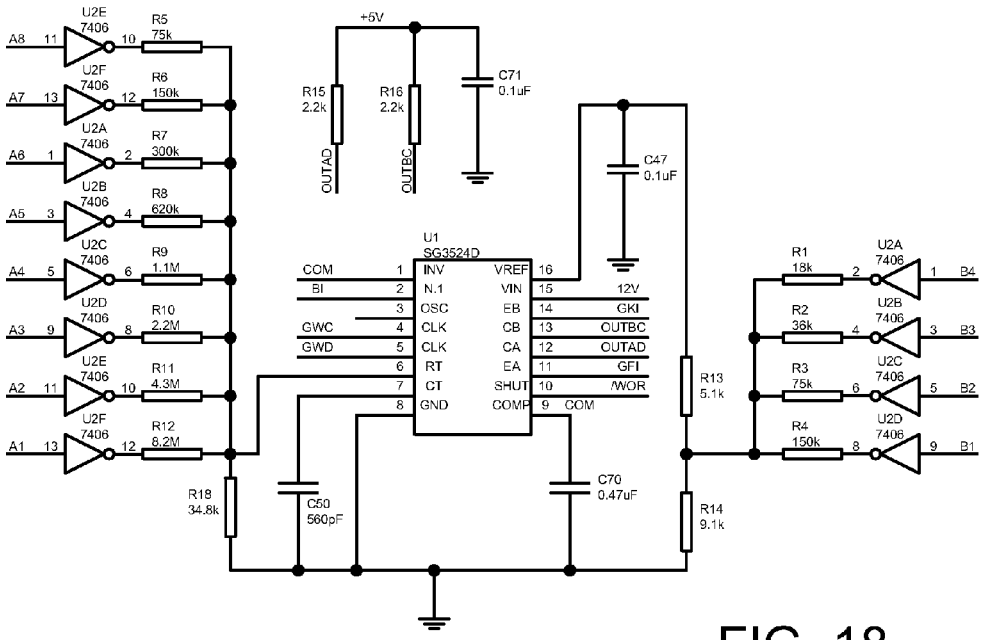
FIG. 18 is a schematic showing an exemplary circuit for variable frequency and variable duty cycle according to the present invention.

FIG. 18 shows a sample circuit where the digital controlled variable resistor is used to generate a square waveform with variable frequency and duty cycle. The "digital controlled variable resistor" shown in FIG. 13 replaces the timing resistor Rt in FIG. 16. Since another digital controlled variable resistor is used for duty control. Therefore, the circuit in FIG. 18 gives out a digital controlled circuit to generate a square waveform with variable frequency, variable duty ratio in wide range and small resolution steps.

The resistor network of R1, R2, R3, R4 and R14 is used for the digital controlled variable resistor working together with the pull-up resistor R13. R13 and R14 help to preset the highest voltage across resistor R14 and this voltage is the input to the error amplifier in SG3524. The error amplifier is in a voltage follower configuration so the output of this error amplifier can follow the voltage set by R13 and the equivalent resistance of the resistor network. The output of the error amplifier is used inside of the SG3524 for the duty ratio control.

The SG3524 can be turned on and off by the binary signal "/WORK" on Pin 10 so the binary input signal can change the output frequency, duty ratio and the on or off working status. In FIG. 18 only more resistor(s) is needed in different combination to change the equivalent resistance of the digital controlled variable resistor.

Figure 19:
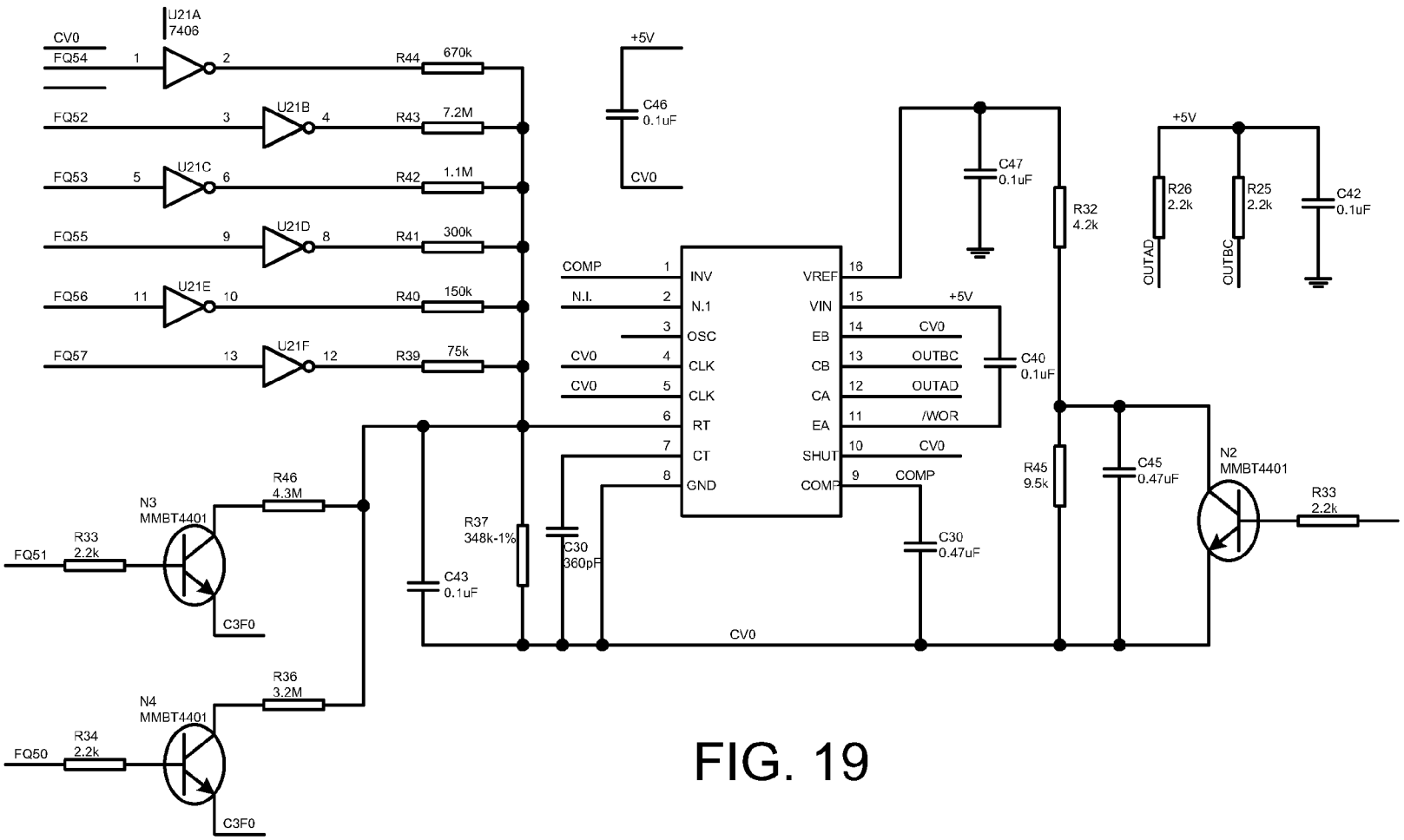
FIG. 19 is a schematic diagram showing an exemplary circuit for variable frequency control according to the present invention.

FIG. 19 shows a practical circuit used under the subject of this invention. This circuit only controls the frequency.

The present invention provides enhanced power management via sensing pan size and material. Control and adjustment of the output power delivered to the cooking utensil and to the heating load is provided to the maximum level while maintaining safe operating conditions for the power circuitry.

Maximum power management has the effect of making all pans receive the maximum power possible set by its operator. Other induction ranges have a very large power output range depending on the pan material and pan site. One such competing unit, rated at 3.5 kW at 240 volts, averaged only 56% of its rated power when tested with 28 different pans. Since productivity is directly related to output power, the end user would have received little more then half of the output power and productivity when using a variety of different pans. With the controls and circuitry of the present invention, the average power is close to 90% for the same 28 pans.

The present invention preferably provides thermal management systems and controls. Control system facilitates automatic temperature sensing and power control for maintaining safe operating temperatures and for regulating and maintaining heating of cooking utensil so that the cooking range will not shut off during the normal cooking cycle through auto power reduction and regulation.

Current induction cookers sense the top plate temperature and when it reaches a high point, the cooker is shut off. This often happens in the middle of cooking.

To avoid this problem, the induction range of the present invention monitors the top plate, heat sink and ambient temperatures and if the limit is reached or approached, the power applied to the induction coil is automatically reduced to a level that will maintain a safe operating system. This reduction in power is invisible to the user and as the temperature drops to designated level, the power will again automatically increase.

The invention is a control system that senses the temperature of the cooking surface, the rate of change of the cooking surface temperature, the internal heat sinks and the ambient temperature and then adjusts the output power to maintain the optimum temperature conditions for the power supply electronics and the other components of the induction range.

As the cooking utensil, the heating load, increases in temperature over time, the temperature of the ceramic glass top is monitored through a thermistor. The temperature of the heat sinks and ambient air are also monitored through thermistors. As the temperature approaches the safe operating temperature limit, preset in the microcontroller software, or the rate of change of the surface temperature is determined to be so fast that the preset temperature limit will be exceeded within a short period of time, the output power to the pan is automatically reduced. The reduction of output power, immediately causes a reduction in energy supplied to the cooking utensil and the temperature of the cooking utensil starts to level off and then drop.

If the temperature falls below the safe regulation level, power is then again increased automatically. Current induction ranges sense the temperature and when the temperature exceeds the upper limit set by the manufacturer, the induction range is turned off.

If the surface temperature should continue to climb, the output power will again be automatically cut back by a certain percent. If the temperature of the cooking surface surpasses a safety limit level, the power supply will be turned off.

The present invention provides high temperature cooking and power control for safe cooking. For stir fry, sauté cooking and searing meats, cooking temperatures in excess of 500 degrees Fahrenheit are required. This brings out the flavors in spices and sears meats. However, these high heating temperatures can pose a danger in some forms of cooking such as boiling oil for deep frying. Deep frying typically occurs between 350 degrees F. and 375 degrees F. The flash point of oil is approximately 450 degrees F. to 500 degrees F. Consequently, most induction cookers set a thermal safety shutoff to shut the cooker off when the top plate approximates a temperature near 450 degrees F.

At high power on the induction range of the present invention, high temperature cooking is only needed for a few minutes. Consequently, the present invention has a unique way of making both of the high temperature cooking and safe electronic temperature limits possible. The present invention enables these high temperatures while sensing if the operator intends to boil water or oil for a long period of time. If boiling water or oil is intended, the temperature of the top plate is limited to 375 to 450 degrees through the power management system.

To get high heating, the present invention allows the cooking pan to heat to its maximum temperature based on the maximum output power for a period of 3 to 5 minutes. The time can be programmed by the present invention based on the OEM manufacturer's requirement. At the end of this time the power is automatically reduced in steps in order to lower the pan temperature to 375 to 425 degrees F. based on the thermistor under the ceramic glass top. This occurs by monitoring the thermistor under the ceramic top. The actual setting and time numbers are variable. It is the unique sequence of events and the process that makes this system very effective with high performance, user friendly, very intelligent and safe to use.

The present invention provides intelligent thermal control. The rate of temperature change is also used to determine the conditions of the cooking vessel and to adjust the power accordingly or a preferred temperature can be set and the digital control system will regulate the power to maintain that temperature. This control together with timing logic for cooking duration can be used to cook certain foods, bring water and soups to a boil and then reduce the temperature to a simmer point, etc.

The present invention provides an intelligent digital control system. A microcontroller facilitates sensing, measuring, comparing, deciding and acting to regulate all operations for maximum efficiency, and maximum performance.

During all cooking operations, the micro-controller is continually monitoring many different sensors including over temperatures, over voltage, over current. These input readings are compared to preprogrammed operating values and the micro-controller then adjusts the operating power to maintain the safe operating conditions for the induction range and maximize the cooking performance for the operator.

Another main reason to use digital control based system with a microcontroller is that it can provide intelligent control functions. In addition, the micro-controller increases the load adaptability of the product to the maximum extent.

The design and operating principles, intelligent control functions, and the innovative digital-controlled variable frequency generator of the intelligent digital control system can be applied to other induction-heating applications.

Intelligent control functions for the induction-cooking range are: very low end power control (digital control system for low end power control) and smooth power adjustment and control (digital control system for smooth power control).

Constant output power control is provided for different loads. Automatic sensing of the size of the load, the pan size and material, and adjustment of the output power to the maximum for that load are integral control components.

Smooth step-by-step, non jittery, digital LED display of output power is facilitated by using a potentiometer and knob. A smooth step-by-step display number is displayed showing the percentage of output power.

The display shows the percent of power setup by the customer. A rotary knob or push button controls the LED digits. A smooth step from one digit to the next is achieved by an invention control used in this range. (Section 5, Patent Claims)

The problem is to present digital display with a rotary knob without the display number jumping back and forth between two numbers. For example, if the power is set to 79%, a typical display will jump or flicker between 78, 79 and 80. The new control technique maintains a constant number and smooth transition between each power setting.

The power supply uses an 8-bit successive approximation A/D converter to detect the voltage divided by a potentiometer. The knob mounted on the front panel turns the potentiometer back and forth to adjust the voltage feed into the ND converter. The ND conversion result is used as an input control setup value for the induction cooker power control.

The A/D converter is functionally divided into 2 basic sub-circuits. They are analog multiplexer and ND converter. The multiplexer uses analog switches to provide for analog inputs. The switches are selectively turned on, depending on the data latched into a 3-bit multiplexer address register. The successive approximation ND converter transforms the analog output of the multiplexer to an 8-bit digital word. The output of the multiplexer goes to one of two comparator inputs. The other input is derived from a 256R resistor ladder. The converter control logic controls the switch tree, funneling a particular tap voltage to the comparator. Based on the result of the comparison, the control logic and the successive approximation register will decide whether the next tap to be selected should be higher or lower than the present tap on the resistor ladder.

No matter how the analog inputs to the ND converter are configured to operate in single-ended, differential, or pseudo-differential modes, an unadjusted error for this type of ND converter exists all the time. The total unadjusted error includes offset, fullscale, linearity, multiplexer, and reference input. The unadjusted error causes an uncertainty of the lowest significant bit of the A/D conversion to result. Some times, the ambient circuit noise and temperature can cause bigger error. In addition to these, there is the aging of the potentiometer, the mounting method, and the customer control routine.

In order to use the A/D conversion data as the input control setup, the micro controller collects certain amount of data first. Then the micro controller calculates the average of these data. The average value of these data is then compared to the final setup value. Hysteresis is used here to modify the input setup. The threshold of the hysteresis is selected according the different application, customer, and different potentiometer adjustment. If the average is higher than the setup by 2, then the micro controller will increase the setup by 1. If the average is lower than the setup by 2, then the micro controller will decrease the setup by 1.

By averaging the A/D data and adding the hysteresis to the control program, the setup value is stabilized and fine tuning of the setup is possible.

The present invention letter utilizes the maximum branch circuit amperage and maximum plug circuit amperage.

Programmed Power control over time is provided. Underwriters Laboratories limit the average amount of power that can be drawn from an induction range over a three hour period. The power must be 80% of the plug and circuit rating. For example, in commercial restaurants a 30 amp plug and receptacle is most popular. Under normal conditions the double element induction range would be limited to operating at 24 amps or approximately 2,500 watts per element at 208 volts. To provide more operating power to the user, the present invention optionally has a double element induction range with 2 elements operating at 3,000 watts each, at 208 volts.

To keep within 80% of the plug rating, the induction range of the present invention reduces the power over the 3 hour period to average out at less then 80% (24 amps). This may be done by lowering the power each hour, 100% first hour, 80% second hour and 60% the third hour or by any other combination which creates an average of 80% of the plug rating. This technique applies for other outlet ratings as well.

When the pan is removed the circuit detects the removal of the pan and no power is drawn by the Circuit for heating the pan. When the pan is replaced within a specified period, the heating resumes at the preset level. The range never stops cooking under normal conditions.

When the pan is removed and not put back on the cooking surface within a specified period of time the range will turn off.

When the range is turned off by pressing the off button or turning the control knob to off, the power to the pan will go off and the cooking fan will continue to operate for 3 minutes or the time specified by the OEM account.

Intelligent protection systems for high reliability and long-term circuit operation are provided. The load characteristics for induction-cooking are difficult to outline due to the wide usage of many different kinds of cookware. The equivalent load for the power inverter of the cookware is dependent on many factors including cookware size, material type, the output heating power, ambient temperature, and control setup, etc. Even the position where the cookware is located on top of the induction cooker can have an effect on the output resonant current, efficiency, and the performance.

These factors present a big potential hazard for the related power inverter circuits both for commercial and residential areas. For example at the same output power, the output current for the poor load could be several times that of the ideal load. More important is that this load characteristic change could happen so quickly that it can easily kill the power device by either over-current or by over-temperature of the power device junction associated with over-current.

Based on the advanced simulation and complete bench experiments, the present invention has developed a protection strategy that is unit-oriented The unit oriented strategy works to protect the unit from abnormal load or abuse.

The customer-oriented strategy works to protect the customer or the cookware as much as possible, but does not take or remove the customer's safety responsibility.

These protection strategies not only increase the lifetime of the power supply but also provides power to poor load.

Aluminum tray used under heating coil to shield electromagnetic noise from electronics. An aluminum tray is used under the heating coil to shield electromagnetic noise from the electronics and to create a more constant inductance seen by the power circuit when different pans are placed on the top of the induction cooker.

Protection system for ceramic glass to prevent spillage during a break or crack of the top ceramic top plate. To protect the electronic circuitry from water spill caused by a broken ceramic top, a rubber or silicone coating or barrier sheet can be placed between the electronics and the silicone glass.

A new ceramic top material is provided. Currently, ceramic glass is expensive and either can be purchased from only two suppliers. We have two solutions: utilize high temperature thermoplastic materials, or utilize granite and/or cement materials.

Current ceramic glass cracks easily and allows water to run into electronic compartment. UL's requirement, in essence, is that if the glass should crack, no water should short out the electronics or cause a short to ground.

One solution is to prepare a new ceramic glass top with a rubberized or high temperature silicone coating on the underside of the ceramic glass. This will make the ceramic glass more resistant to breaking and also create a water barrier in any area where the glass should crack. The coating could be applied at the glass factory as part of the manufacturing process making it easy to produce and cost effective.

A second method of accomplishing the same result is to attach or suspend a rubber or silicone barrier between the electronic compartment and the ceramic glass top. This technique could be accomplished during construction by adding a silicone or rubber sheet between the glass top and the inside electronics.

This particular concept could have a widespread use in all induction ranges no matter who would make them. We would want this aspect to stand on its own and eventually, license the two major glass manufacturers to use this concept.

Variable power indication is provided through the use of a variable intensity light, preferably, variable power indication through the use of a variable intensity light under the induction work coil.

A method for displaying heating power utilizes variable lighting of the ceramic glass top. A light source is to be placed under the ceramic top with a variable output. The power output of the induction cooking element can be shown by an illuminated ring around the induction coil. A light tube or individual lights may be used to create the light ring. Power and intensity of the light ring may be controlled by the adjustment of the input power to the lights.

The output of the light source would be tied to the output of the power supply, either through electronic or mechanical means. As the power increased the light intensity under the glass would also increase. The light could be a single source light or a band of lights partially around the heating coil or completely circling the heating coil.

Currently with induction ranges there is no good visual indication of the heating power of the induction ranges. With gas ranges you can see the level of the flame and with coil you can see the color changing. This new invention improves the visual feedback to the user and makes the induction range much easier to use.

The present invention is further related to an improved method of cooking and baking with the use of induction heating. The induction conveyor or deck oven uses a ferrous metal pan placed on top of a work coil heated by a magnetic field produced by an induction generating power supply. The advantages of the induction oven are that:

a) the induction oven can maintain very constant temperatures in the oven cavity;

b) the floor of the oven can be used to directly cook certain foods, such as breads, pizza and other bakery items.

The design of the induction oven would have a coil placed under the bottom of the oven floor for a deck oven. In the case of a conveyor oven, the work coil would be placed under a moving or not along conveyor belt which would move a pan into position for heating.

By adjusting the power level output of the inverter or by adjusting the time the cooking pan is over the induction work coil, the temperature of the cooking pan can be controlled.

A variation on the above design is to use a metal alloy whose Currie temperature point is set to be at the level of the desired cooking temperature. Then by applying an induction field to the cooking pan made of the special alloy, the pan will reach the desired temperature and stay at that temperature. Since the metal alloy will loose its magnetic properties when it reaches its Currie temperature point, the pan will maintain a constant cooking temperature.

Baking breads and crusts for pizza in a short time is a major challenge for the foodservice industry. The ideal crusts are baked in large, slow cooking deck ovens. Today prebaked crusts are used to speed up the cooking process but the quality is not as good as fresh baked crusts. The induction heated baking system on a conveyor or deck oven has many advantages and can produce the same effect as with the conventional deck oven but in less time, with less cost and with less energy.

The present invention also relates to an induction heated water heater and booster heater which are designed to provide rapid heat up of water for use in commercial and residential appliances.

The design utilizes a ferrous container which is heated by the application of a magnetic field applied to the outer shell of the container. A coil may be designed heating one side of the container to produce steam or the coil may be designed to completely enclose the container in order to generate a rapid hot water booster heater or conventional induction powered water eater. The power supply is enclosed in an adjoining compartment or remote.

Current units require a long heat up time and use elements immersed in the chamber. These elements become covered with scale and lime and loose their effectiveness. The induction water booster heater would solve these problems and provide a faster heat up of the water. In addition the design provides for less scale accumulation and easy cleaning.

Induction heated constant temperature holding pans or closed containers for holding and serving food, heating liquids or food products to a desired temperatures by using a magnetic alloy metal with a Currie point set to match the desired holding temperature of the liquid or food product.

The holding pan would be formed from the metal alloy and then the holding pan would be heated through application of the magnetic field created by the induction power supply. At the Currie point of the material, the pan would no longer be magnetic and the pan would stop heating. This invention would also put energy and heat to the cold spots of the holding pan insuring even heat distribution throughout the holding pan. Current holding pans are heated with hot water and are messy and difficult to control the desired temperatures.

Utilizing the hot water booster heater which is heated by induction, the washing machine can be made much more energy efficient and will provide a superior wash with the super heated hot water. The input water to the washing machine could be cold or hot water. The booster heater will heat the water to the desired temperature and then feed it to the washing tub. Rapid heat up of the water with high efficiency induction heating will save energy and the extra hot water will provide a better wash. The water heater section would be placed inline with the supply water.

The booster heater would be fabricated from a ferrous metal and a coil would be formed to surround the chamber. Application of a magnetic field to the water chamber will generate heat in the chamber and heat the water. The water temperature can be controlled by the use of a thermostat. For single temperature systems, the chamber can also be controlled by the use of a metal alloy which has a Currie temperature set to the desired temperature for holding the water.

Current washing machines use hot water supplied from the household hot water supply which is limited to the supply temperature of the home's water heater, or the washing machine uses an internal water heating-system based on resistive type heating elements. The resistive heating elements are slow to heat up and become covered with scale, thus reducing their efficiency. Over time, the heating chamber becomes clogged and ineffective. Induction heated water for the washing cycle overcomes these and many other challenges and produces a better wash because of the higher wash temperatures.

An induction clothes dryer provides a very even heat distribution and a high energy efficiency. The induction clothes dryer is designed to heat a ferrous dryer tub by the use of induction coil designed to heat a section of the dryer at a time or a continuous loop of coil in which the dryer tub spins.

The induction clothes dryer allows most of the input energy to be applied to heating the dryer drum. By spinning the dryer drum, air circulation and even heat distribution is applied to all the clothes. An auxiliary fan may be used to circulate the air inside of the dryer drum. A much more constant drying temperature can be maintained.

Current clothes dryers utilize either gas heating or electric resistive heating to indirectly heat the chamber in which the clothes are drying. This process is inefficient and wastes energy. With induction heating, the correct amount of heat can be placed directly to the drying drum which in turn will heat the air and the clothes in a much more efficient manner.

Current home delivery systems use resistive heaters, heated pellets and other forms for keeping heat in the bag. This new induction heated system provides a more energy efficient, superior heating system and at less cost.

The present invention relates to an improved system for keeping food warm during delivery to a patient in a hospital or to a home, such as pizza delivered to homes. An induction heated thermal bag for use in home delivery of foods is designed using ferrous steel plates which are heated through a magnetic field. The magnetic field is generated by an induction power supply.

The design is made in various forms, for example:

a. A chamber is created by an enclosed coil When the thermal bag is placed within the magnetic field, the steel plates inside of the bag are heated through the induced magnetic field. Temperature of the steel plates is controlled by the time the inverter is powered on and the time the magnetic field is applied to the steel plates.

b. The temperature of the ferrous plates may also be maintained by the use of a thermal switch to control the upper temperature of the bag.

c. The temperature of the plates in the thermal bag may be maintained by the use of a metal allow whose temperature is set by the Currie temperature of the metal alloy.

The present invention relates to an improved system for keeping food warm during delivery to a patient in a hospital or to a home, such as pizza, Chinese food, etc. An induction heated thermal box is designed used corrugated paper and metal foil which becomes heated through a magnetic field. The corrugated paper and foil is so constructed as to trap the heat generated by the foil in the corrugated channels of the food container or pizza box.

Novel features of the present invention include: voltage sensing circuitry to enable operating over large input voltage range; digitally controlled circuit design with interface to micro-controller to generate a square waveform with a wide frequency range with small, smooth resolution (this control circuit could be used for many other applications); combination of digitally controlled circuit above with full bridge and half bridge resonant circuits; power adjusted based on pan size and material, frequency response, resistance, adjusts power to maximum level for particular pan; maximum power output management for each pan to give the most power output for different types of pans; maximum branch circuit and plug amperage usage; does not stop cooking, the power is adjusted to maintain a safe operating limit; for the range over voltage protection; over current protection; senses and measures temperature points, ceramic glass top, heat sinks, and ambient air temp and regulates output power to maintain desired operating temperatures; provides high temperature cooking and allows high temperature cooking for a limited time period; an intelligent thermal control system determines if user intends to boil or stir fry and adjusts power to regulate temperature, preferably to a safe limit; provides time and temperature regulation function to values set by the operator; has enhanced low end power control; smooth power control; smooth non jittery display, fan continues to run until fixed time after power turn off or until temperature reaches a desired limit point; an intelligent protection system strategy provides high reliability, long term circuit operation; each building block is self regulating and has its own protection system; each building block communicates to the others; maximum performance and reliability is obtained by the integration of these independent, self protecting, blocks; an EMI filter circuit design provides EMI noise filtering; silicone or rubber coating protects against spillage of water into electronic compartments; a visual display of output power is provided wherein a variable output light source is placed under the glass top (at low power a dim light appears and increases to a bright light at high power such that the light can represent a general "glow" as with gas or a more defined "spot" light or a light source with a variable pulsing frequency based on power output (low pulse rate for low power increasing to a high pulse rate and then a steady on at maximum power).

It is understood that the exemplary induction heating and control system and method described herein and shown in the drawings represents only presently preferred embodiments of the invention. Indeed, various modifications and additions may be made to such embodiments without departing from the spirit and scope of the invention. Thus, various modifications and additions may be obvious to those skilled in the art and may be implemented so as to adapt the present invention for use in a variety of different applications.

LIST OF COMPONENTS

1001 Voltage Management
1002 Digital Circuit for square waveform, variable frequency control
1003 Power Management
1004 Temperature Management System
1005 Digital Control System
1006 Protection Operating System
1007 EMI Filter
8 Protection System from Cracked Ceramic Top
9 Variable Light Source
10 Induction Heating System
11 Main Power Stage
15 Metal Case
16 Cookware
17 Ceramic Glass Top
18 Rubber or Silicon Coating, or Barrier Sheet
20 Rotary Control Display
21 Push Button Display
22 Full/Half Bridge Work Coil
32 EMI Board
33 Power Board
34 Cooling Fan
35 Rotary Knob
36 Push Button
43 Rotary Knob Control
44 Digital Readout
45 On/Off Button
48 Push Button
49 Push Button
50 EMI Filter Circuit
80 EMI, Power Input
81 Choke
82 Caps
83 Chokes
84 Fan Connector
85 EMI Output
86 Micro-Controller
87 Display/Control Panel Connector
88 Display/Control Board
89 ND Converter
90 Transformer
91 Heat Sink IGBT
92 Heat Sink Input Bridge
93 Caps
94 Caps
95 Power Output
96 Air Flow.
97 Capacitor
98 Standoffs
99 Fuse
100 Auxiliary Power Supply
140 Gate Driver Power Supply
170 IGBT Gate Drivers
190 Sensor Thermistor Top Plate Temperature
191 Sensor Thermistor Power Heat Sink Temp
192 Sensor Thermistor Bridge Heat Sink Temp
193 Sensor Thermistor Ambient Temp
194 Sensor Thermistor Coil Current
195 Voltage Sensor
196 Current Sensor—Input Circuit
200 Input Voltage
220 Output Power Circuitry
225 Output Power
230 Input Current
240 Output Current
250 Digital Controlled Circuitry
270 Power Management Circuitry

What is claimed is:

1. A method for varying the amount of heat provided by an induction cooker, the method comprising:

using a microprocessor to receive inputs from user interface elements and to generate outputs using logic of the microprocessor;

providing an oscillator configured such that a frequency of an oscillator output depends upon a resistance; and digitally switching a resistor network by providing the outputs from the microprocessor to the resistor network, the resistor network coupled to the oscillator such that the resistor network directly varies the resistance provided to the oscillator in a manner which varies the frequency of the output of the oscillator.

2. A high resolution, variable frequency waveform generator comprising:

an oscillator configured such that a frequency of an oscillator output depends upon a resistance; and a digitally switched resistor network coupled to the oscillator such that the resultant resistance of the resistor network directly, and without further processing by a microprocessor, varies the resistance provided to the oscillator in a manner which varies the frequency of the output of the oscillator.

3. The waveform generator as recited in claim 2, wherein the oscillator is configured to output a square wave.

4. The waveform generator as recited in claim 2, wherein the oscillator is configured to output a sinusoidal wave.

5. The waveform generator as recited in claim 2, wherein the oscillator is configured to output a sawtooth wave.

6. The waveform generator as recited in claim 2, wherein the oscillator is configured to output a triangular wave.

7. The waveform generator as recited in claim 2, wherein the oscillator is configured such that a duty cycle of an output thereof depends upon the resistance provided by the digitally switched resistor network, and the digitally switched resistor network configured to vary the resistance provided thereby to the oscillator in a manner which varies the duty cycle of the output of the oscillator.

8. The waveform generator as recited in claim 2, wherein the resistor network comprises a plurality of resistors and each succeeding resistor has a value of approximately twice that of each preceding resistor.

9. An induction cooker comprising:

an oscillator configured such that a frequency of an oscillator output depends upon a resistance; and a microprocessor configured to use input from a user interface element to determine an output for providing to the digitally switched resistor network;

a digitally switched resistor network coupled to the oscillator and configured to directly vary the resistance provided to the oscillator in a manner which varies the frequency of the output of the oscillator.

10. The induction cooker as recited in claim 9, wherein the oscillator is configured to output a square wave.

11. The induction cooker as recited in claim 9, wherein the oscillator is configured to output a sinusoidal wave.

12. The induction cooker as recited in claim 9, wherein the oscillator is configured to output a sawtooth wave.

13. The induction cooker as recited in claim 9, wherein the oscillator is configured to output a triangular wave.

14. The induction cooker as recited in claim 9, wherein the oscillator is configured such that a duty cycle of an output thereof depends upon the resistance provided by the digitally switched resistor network, and the digitally switched resistor network configured to vary a resistance provided thereby to the oscillator in a manner which varies the duty cycle of the output of the oscillator.

15. The induction cooker as recited in claim 9, further comprising a half-wave rectifier resonant circuit receiving a signal from the oscillator and generating a magnetic field to effect cooking.

16. The induction cooker as recited in claim 9, further comprising a full-wave rectifier resonant circuit receiving a signal from the oscillator and generating a magnetic field to effect cooking.

* * * * *